US011339698B2

(12) United States Patent
Bare et al.

(10) Patent No.: US 11,339,698 B2
(45) Date of Patent: May 24, 2022

(54) MULTIPLE HEATER EXHAUST AFTERTREATMENT SYSTEM ARCHITECTURE AND METHODS OF CONTROL THEREOF

(71) Applicant: Cummins Inc., Columbus, IN (US)

(72) Inventors: Kristopher R. Bare, Columbus, IN (US); Xing Jin, Columbus, IN (US); Jennifer Kay Light-Holets, Greenwood, IN (US); Sriram S. Popuri, Greenwood, IN (US); Xiaobo Song, Columbus, IN (US)

(73) Assignee: Cummins Inc., Columbus, IN (US)

( * ) Notice: Subject to any disclaimer, the term of this patent is extended or adjusted under 35 U.S.C. 154(b) by 0 days.

(21) Appl. No.: 16/884,897

(22) Filed: May 27, 2020

(65) Prior Publication Data

US 2021/0372310 A1 Dec. 2, 2021

(51) Int. Cl.
*F01N 3/20* (2006.01)
*F01N 13/00* (2010.01)
(Continued)

(52) U.S. Cl.
CPC ..... *F01N 3/2013* (2013.01); *F01N 3/023* (2013.01); *F01N 13/009* (2014.06);
(Continued)

(58) Field of Classification Search
CPC ..... F01N 3/2013; F01N 3/023; F01N 13/009; F01N 2610/03; F01N 2550/22; F01N 11/002; F01N 3/2066; F01N 2260/08
See application file for complete search history.

(56) References Cited

U.S. PATENT DOCUMENTS 3,975,951 A 8/1976 Kohama et al.
4,449,362 A 5/1984 Frankenberg et al.
(Continued)

FOREIGN PATENT DOCUMENTS

DE 10 2008 030 307 12/2009
DE 10 2012 007 053 10/2013
(Continued)

OTHER PUBLICATIONS

International Search Report and Written Opinion on PCT/US2020/034650, dated Aug. 4, 2020, 11 pages.

*Primary Examiner* — Brandon D Lee
(74) *Attorney, Agent, or Firm* — Foley & Lardner LLP

(57) ABSTRACT

A system includes a first heater positioned in or proximate to an exhaust aftertreatment system in exhaust gas-receiving communication with an engine, a second heater positioned downstream of the first heater, and a controller coupled to the first and second heaters. The controller is structured to determine, based on information indicative of a temperature regarding the exhaust aftertreatment system, that the temperature is below a temperature threshold; receive information regarding a characteristic of a battery coupled to the first heater and the second heater; control the temperature regarding the exhaust aftertreatment system without using the first or second heaters in response to determining that the characteristic of the battery is below a first threshold; and control a temperature regarding the exhaust aftertreatment system using the first heater in response to determining that the characteristic of the battery is above the first threshold but below a second threshold.

7 Claims, 8 Drawing Sheets

(51) Int. Cl.
*F01N 3/023* (2006.01)
*F01N 11/00* (2006.01)

(52) U.S. Cl.
CPC ..... *F01N 3/2066* (2013.01); *F01N 11/002* (2013.01); *F01N 2260/08* (2013.01); *F01N 2550/22* (2013.01); *F01N 2610/03* (2013.01)

(56) References Cited

U.S. PATENT DOCUMENTS

| | | | | |
|---|---|---|---|---|
| 5,746,053 | A * | 5/1998 | Hibino | F01N 11/007 60/277 |
| 6,032,461 | A | 3/2000 | Kinugasa et al. | |
| 6,325,053 | B1 | 12/2001 | Zappador et al. | |
| 6,477,831 | B1 | 11/2002 | Ballinger et al. | |
| 6,681,563 | B2 | 1/2004 | Glugla et al. | |
| 7,104,051 | B2 | 9/2006 | Shimasaki et al. | |
| 8,042,326 | B2 | 10/2011 | Farell et al. | |
| 8,051,644 | B2 | 11/2011 | Gonze et al. | |
| 8,117,832 | B2 | 2/2012 | Wagner et al. | |
| 8,347,607 | B2 | 1/2013 | Gonze et al. | |
| 8,475,574 | B2 | 7/2013 | Gonze et al. | |
| 8,505,282 | B2 | 8/2013 | Gonze et al. | |
| 8,883,102 | B1 | 11/2014 | Lambert et al. | |
| 9,038,376 | B2 | 5/2015 | Petrovic et al. | |
| 9,328,674 | B2 | 5/2016 | Geveci et al. | |
| 9,388,722 | B2 | 7/2016 | Gonze et al. | |
| 9,470,128 | B2 | 10/2016 | Silvers et al. | |
| 9,863,352 | B2 | 1/2018 | Stenlaas et al. | |
| 9,878,767 | B2 | 1/2018 | Dahlberg et al. | |
| 9,968,886 | B2 * | 5/2018 | Balenovic | F01N 3/0842 |
| 10,273,846 | B2 | 4/2019 | Baensch et al. | |
| 10,371,029 | B2 | 8/2019 | Sakuma et al. | |
| 10,408,103 | B1 * | 9/2019 | Miao | B01D 53/944 |
| 10,494,971 | B2 | 12/2019 | Younkins et al. | |
| 2009/0000604 | A1 | 1/2009 | Bond et al. | |
| 2012/0102920 | A1 | 5/2012 | Pipis, Jr. | |
| 2012/0173062 | A1 | 7/2012 | Madurai Kumar et al. | |
| 2013/0047607 | A1 * | 2/2013 | Petrovic | F02D 21/08 60/605.2 |
| 2013/0213010 | A1 | 8/2013 | Zhang et al. | |
| 2015/0315952 | A1 | 11/2015 | Hall | |
| 2016/0153417 | A1 | 6/2016 | Tochigi | |
| 2017/0130630 | A1 | 5/2017 | Younkins | |
| 2018/0094556 | A1 | 4/2018 | Kurtz et al. | |
| 2018/0142599 | A1 | 5/2018 | Pannuzzo et al. | |
| 2018/0202985 | A1 | 7/2018 | Wait | |
| 2018/0334939 | A1 | 11/2018 | Mital et al. | |
| 2018/0334970 | A1 | 11/2018 | Kamo | |
| 2019/0155230 | A1 | 5/2019 | Culbertson et al. | |
| 2019/0360415 | A1 | 11/2019 | Romanato | |
| 2020/0102874 | A1 * | 4/2020 | Kurtz | F02D 29/02 |
| 2020/0408163 | A1 | 12/2020 | Webb et al. | |

FOREIGN PATENT DOCUMENTS

| | | |
|---|---|---|
| DE | 10 2015 200 023 | 7/2015 |
| GB | 2 478 541 | 9/2011 |
| WO | WO-2006/012484 | 2/2006 |
| WO | WO-2006/100051 | 9/2006 |
| WO | WO-2008/109215 | 9/2008 |
| WO | WO-2012/040613 | 3/2012 |
| WO | WO-2014/055018 | 4/2014 |
| WO | WO-2016/029207 | 2/2016 |
| WO | WO-2020/074268 | 4/2020 |
| WO | WO-2021/069162 | 4/2021 |

* cited by examiner

MULTIPLE HEATER EXHAUST AFTERTREATMENT SYSTEM ARCHITECTURE AND METHODS OF CONTROL THEREOF

TECHNICAL FIELD

The present disclosure relates to an exhaust aftertreatment system. More particularly, the present disclosure relates to a particular architecture for an exhaust aftertreatment system having two heaters and control methods thereof.

BACKGROUND

Emissions regulations for internal combustion engines have become more stringent over recent years. Environmental concerns have motivated the implementation of stricter emission requirements for internal combustion engines throughout much of the world. Government agencies, such as the Environmental Protection Agency (EPA) in the United States, carefully monitor the emission quality of engines and set emission standards to which engines must comply. Consequently, the use of exhaust aftertreatment systems to treat engine exhaust gas to reduce emissions is increasing.

Exhaust aftertreatment systems are generally designed to reduce emission of particulate matter, nitrogen oxides (NOx), hydrocarbons, and other environmentally harmful pollutants. Exhaust aftertreatment systems treat engine exhaust gas with catalysts and reductant to convert NOx in the exhaust gas into less harmful compounds. Some of the catalysts in the exhaust aftertreatment system are typically more efficient at converting NOx into less harmful compounds at hot temperatures. Therefore, components of the exhaust aftertreatment system may be heated to promote catalyst efficiency.

SUMMARY

One embodiment relates to a system. The system includes a first heater, a second heater, and a controller. The first heater is positioned in or proximate to an exhaust aftertreatment system in exhaust gas-receiving communication with an engine. The second heater is positioned downstream of the first heater. The controller is coupled to the first and second heaters. The controller is structured to determine, based on information indicative of a temperature regarding the exhaust aftertreatment system, that the temperature regarding the exhaust aftertreatment system is below a predefined temperature threshold. The controller is structured to receive information regarding a characteristic of a battery coupled to the first heater and the second heater. The controller is structured to control a temperature regarding the exhaust aftertreatment system without using the first heater or the second heater in response to determining that the characteristic of the battery is below a first predefined threshold. The controller is structured to control a temperature regarding the exhaust aftertreatment system using the first heater in response to determining that the characteristic of the battery is above the first predefined threshold but below a second predefined threshold.

Another embodiment relates to a system. The system includes a first heater, a second heater, and a controller. The first heater is positioned in or proximate to an exhaust aftertreatment system in exhaust gas-receiving communication with an engine. The second heater is positioned downstream of the first heater. The controller is coupled to the first and second heaters. The controller is structured to activate the second heater in response to determining that a compound deposit is likely present.

Another embodiment relates to a system. The system includes a first heater, a second heater, and a controller. The first heater is positioned in or proximate to an air intake of an engine. The second heater is positioned in exhaust gas-receiving communication with the engine. The controller is coupled to the first and second heaters. The controller is structured to determine, based on information indicative of a temperature regarding the exhaust aftertreatment system, that the temperature regarding the exhaust aftertreatment system is below a predefined temperature threshold. The controller is structured to determine that the second heater is in or likely in an error state. The controller is structured to control a temperature regarding the exhaust aftertreatment system using the first heater in response to determining that the second heater is in or likely in an error state. The first heater controls the temperature regarding the exhaust aftertreatment system after a temperature regarding an engine intake air is at or above a predefined air intake temperature threshold.

These and other features, together with the organization and manner of operation thereof, will become apparent from the following detailed description when taken in conjunction with the accompanying drawings.

DETAILED DESCRIPTION

Figure 1:
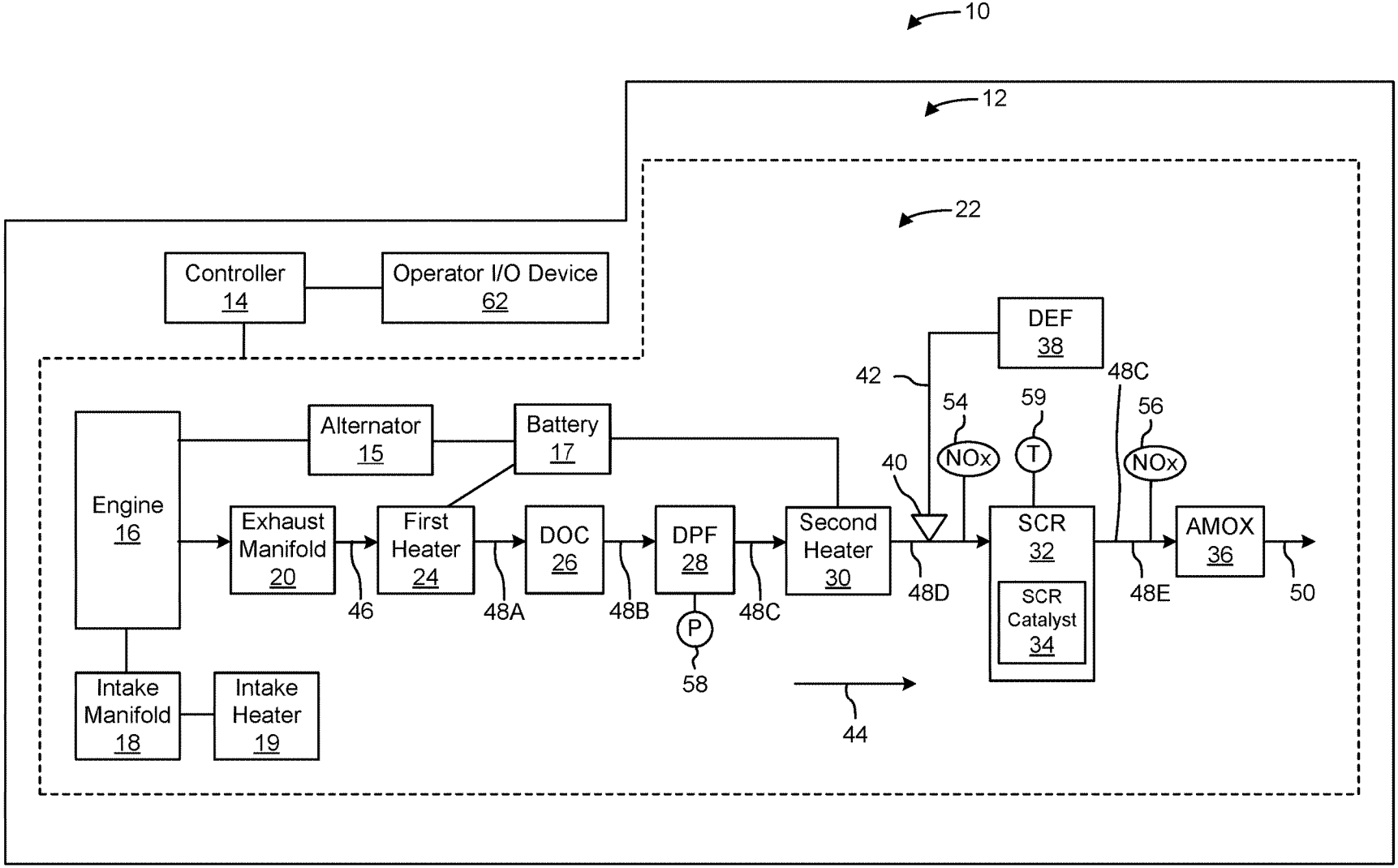
FIG. 1 is a schematic diagram of an exhaust aftertreatment system with a controller, according to an example embodiment.

Following below are more detailed descriptions of various concepts related to, and implementations of, methods, apparatuses, and systems for heating an exhaust aftertreatment system using electric heaters powered by a battery. The various concepts introduced above and discussed in greater detail below may be implemented in any number of ways, as the concepts described are not limited to any particular manner of implementation. Examples of specific implementations and applications are provided primarily for illustrative purposes.

Based on the foregoing and referring to the figures generally, the various embodiments disclosed herein relate to systems, apparatuses, and methods for an exhaust aftertreatment system with two heaters and operation thereof, either alone or in combination.

In some aspects of the present disclosure, the exhaust aftertreatment system includes a first aftertreatment heater positioned in or proximate to an exhaust aftertreatment system in exhaust gas-receiving communication with an engine. The second aftertreatment heater is positioned downstream of the first aftertreatment heater within or proximate the aftertreatment system. A controller coupled to the first and second aftertreatment heaters is structured to determine, based on information indicative of a temperature regarding the exhaust aftertreatment system, that the temperature regarding the exhaust aftertreatment system is below a predefined temperature threshold. The controller is structured to receive information regarding a characteristic of a battery coupled to the first and the second aftertreatment heaters. The controller is structured to control a temperature regarding the exhaust aftertreatment system without using the first or second aftertreatment heaters in response to determining that the characteristic of the battery is below a first predefined threshold. The controller is structured to control a temperature regarding the exhaust aftertreatment system using the first aftertreatment heater in response to determining that the characteristic of the battery is above the first predefined threshold but below a second predefined threshold. In such conditions, the controller may be structured to control an amount of heat provided by the first aftertreatment heater based on the characteristic of the battery. The controller may also be structured to determine that the first aftertreatment heater is likely in an error state. The controller may then control the temperature of the exhaust aftertreatment system using the second heater instead of the first heater.

In some aspects of the present disclosure, the controller may activate the first aftertreatment heater and/or the second aftertreatment heater to remove one or more compound deposits in the exhaust aftertreatment system (e.g., a urea deposit). For example, the controller may be structured to activate the second aftertreatment heater in response to determining that a compound deposit is at or above a compound deposit threshold. The controller may activate the first aftertreatment heater in response to the compound deposits persisting after a predefined time period.

In some aspects of the present disclosure, the system includes an engine intake heater positioned in or proximate to an air intake of the engine. An exhaust aftertreatment heater is positioned in exhaust gas-receiving communication with the engine. A controller coupled to the engine intake heater and the exhaust aftertreatment heater is structured to determine, based on information indicative of a temperature regarding the exhaust aftertreatment system, that the temperature regarding the exhaust aftertreatment system is below a predefined temperature threshold. The controller is structured to determine that the aftertreatment heater is in or likely in an error state. The controller is structured to control a temperature regarding the exhaust aftertreatment system using the engine intake heater in response to determining that the aftertreatment heater is in or likely in an error state. The engine intake heater controls the temperature regarding the exhaust aftertreatment system after a temperature regarding an engine intake air is at or above a predefined air intake temperature threshold.

The exhaust aftertreatment system includes components that operate more effectively at high temperatures. Such components may include aftertreatment catalysts such as a selective catalytic reduction (SCR) catalyst and an ammonia oxidation (AMOx) catalyst. The exhaust aftertreatment system may be heated by the engine (e.g., by commanding the engine to operate to produce exhaust gas at high temperatures). However, under some conditions, such as cold start, low-to-medium load, low-to-medium torque, and/or low-to-medium speed conditions, the engine may not be able to generate exhaust gas that is hot enough to heat the components of the exhaust aftertreatment system. It is therefore advantageous to use heaters positioned in or proximate to the exhaust aftertreatment system to heat the exhaust aftertreatment system.

Referring now to FIG. 1, a vehicle 10 having an engine system 12 including a controller 14 is shown, according to an example embodiment. The vehicle 10 may include an on-road or an off-road vehicle including, but not limited to, line-haul trucks, mid-range trucks (e.g., pick-up trucks), cars, boats, tanks, airplanes, and any other type of vehicle that utilizes an exhaust aftertreatment system. In various alternate embodiments, the systems, methods, and apparatuses may be used with any engine exhaust aftertreatment system (e.g., a stationary power generation system).

As shown in FIG. 1, the engine system 12 includes an internal combustion engine, shown as engine 16, and an exhaust aftertreatment system, shown as exhaust aftertreatment system 22. The engine 16 may be coupled to an alternator 15 structured to provide power to a battery 17 and/or one or more electric heaters. The engine 16 includes an air intake manifold 18 through which air from the environment enters the engine 16 for combustion. In some embodiments, the air intake manifold 18 may include an intake heater 19. The intake heater 19 may be coupled to the air intake manifold 18 to heat the air at or before the air enters the engine 16. Alternatively, the intake heater 19 may be positioned further upstream and away from the engine 16 (e.g., coupled to piping or a conduit that is coupled to the air intake manifold 18). In the illustrated embodiment, the intake heater 19 is a grid heater that is structured to heat the air flowing through the air intake manifold 18 via convection. The intake heater 19 is an electric heater and may be powered by an alternator 15 and/or a battery 17 of the vehicle 10. In some embodiments, the intake heater 19 is a grid heater. In other embodiments, the intake heater 19 may be another type of heater, such as an induction heater, a microwave heater, or a fuel burner. In addition to heating the air in the air intake manifold 18 during a predefined engine warmup time period, the intake heater 19 may be used to continue heating the air in the air intake manifold 18 after the predefined engine warmup time period to provide heat to the exhaust aftertreatment system 22, which is downstream of the intake heater 19.

According to one embodiment, the engine 16 is structured as a compression-ignition internal combustion engine that utilizes diesel fuel. However, in various alternate embodiments, the engine 16 may be structured as any other type of engine (e.g., spark-ignition) that utilizes any type of fuel (e.g., gasoline, natural gas). Within the engine 16, air from the atmosphere is combined with fuel, and combusted, to power the engine 16. Combustion of the fuel and air in the compression chambers of the engine 16 produces exhaust gas that is operatively vented to an exhaust manifold 20 and to the exhaust aftertreatment system 22.

The exhaust aftertreatment system 22 is in exhaust gas-receiving communication with the engine 16. In the example depicted, the exhaust aftertreatment system 22 includes a first aftertreatment heater 24, a diesel oxidation catalyst (DOC) 26, a diesel particulate filter (DPF) 28, a second aftertreatment heater 30, a selective catalytic reduction (SCR) system 32 with a SCR catalyst 34, and an ammonia oxidation (AMOx) catalyst 36. The SCR system 32 further includes a reductant delivery system that has a reductant source, shown as diesel exhaust fluid (DEF) source 38, that supplies reductant (e.g., DEF, urea, ammonia) to a reductant doser 40, via a reductant line, shown as reductant line 42. In another example, the SCR system 32 may include multiple reductant dosers 40 positioned along the exhaust aftertreatment system 22. Although the exhaust aftertreatment system 22 shown includes the DOC 26, the DPF 28, the SCR catalyst 34, and the AMOx catalyst 36 positioned in specific locations relative to each other along the exhaust flow path, in other embodiments, the exhaust aftertreatment system 22 may include more than one of any of the various catalysts positioned in any of various positions relative to each other along the exhaust flow path as desired. Further and in this regard, it should be noted that the components of the exhaust aftertreatment system 22 may be in a variety of different orders; different components may be used in other embodiments; not all the components shown in this embodiment may be used in other architectures; and, various other modifications may be used without departing from the spirit and scope of the present disclosure. Therefore, the architecture of the exhaust aftertreatment system 22 shown in FIG. 1 is for illustrative purposes and should not be considered to be limiting.

In an exhaust flow direction, as indicated by directional arrow 44, exhaust gas flows from the engine 16 into inlet piping 46 of the exhaust aftertreatment system 22. From the inlet piping 46, the exhaust gas flows into the first aftertreatment heater 24 and exits the first aftertreatment heater 24 into a first section of exhaust piping 48A. From the first section of exhaust piping 48A, the exhaust gas flows into the DOC 26 and exits the DOC 26 into a second section of exhaust piping 48B. From the second section of exhaust piping 48B, the exhaust gas flows into the DPF 28 and exits the DPF 28 into a third section of exhaust piping 48C. From the third section of exhaust piping 48C, the exhaust gas flows into the second aftertreatment heater 30 and exits the second aftertreatment heater 30 into a fourth section of exhaust piping 48D. From the fourth section of exhaust piping 48D, the exhaust gas flows into the SCR catalyst 34 and exits the SCR catalyst 34 into a fifth section of exhaust piping 48E. As the exhaust gas flows through the fourth section of exhaust piping 48D, it may be periodically dosed with reductant (e.g., DEF, ammonia, urea) by the reductant doser 40. Accordingly, the third section of exhaust piping 48C may act as a decomposition chamber or tube to facilitate the decomposition of the reductant to ammonia. From the fifth section of exhaust piping 48E, the exhaust gas flows into the AMOx catalyst 36 and exits the AMOx catalyst 36 into outlet piping 50 before the exhaust gas is expelled from the exhaust aftertreatment system 22. Based on the foregoing, in the illustrated embodiment, the first aftertreatment heater 24 is positioned upstream of the DOC 26, the DOC 26 is positioned upstream of the DPF 28, the DPF 28 is positioned upstream of the second aftertreatment heater 30, the second aftertreatment heater 30 is positioned upstream of the SCR catalyst 34, and the SCR catalyst 34 is positioned upstream of the AMOx catalyst 36. However, in other embodiments and as describe above, other arrangements of the components of the exhaust aftertreatment system 22 are also possible.

In the illustrated embodiment, the first and second aftertreatment heaters 24, 30 are grid heaters that are structured to heat the exhaust gas flowing through the exhaust aftertreatment system 22 via convection. The first and second aftertreatment heaters 24, 30 are electric heaters and may be powered by the alternator 15 and/or the battery 17 of the vehicle 10. In some embodiments, the first and second aftertreatment heaters 24, 40 are grid heaters. In other embodiments, the first and second aftertreatment heaters 24, 30 may include be one or more of a heater within the SCR system 32, an induction heater, a microwave heater, and or a fuel burner. In other embodiments, the first and second aftertreatment heaters 24, 30 may be the same type of heater or be different types of heaters. In addition to heating the exhaust, the first and second aftertreatment heaters 24, 30, either alone or in combination, may be used in the controlled regeneration of, for example, the SCR catalyst 34 and/or the AMOx catalyst 36. The first and second aftertreatment heaters 24, 30, either alone or in combination, may also be used to aid or facilitate removal of compound deposits from the exhaust aftertreatment system 22. The compound deposits may include reductant deposits in or near the reductant doser 40. The first aftertreatment heater 24 may also be used in the controlled regeneration of the DOC 26 and/or the DPF 28. In some embodiments, the exhaust aftertreatment system 22 may not include the first aftertreatment heater 24 (i.e., one aftertreatment system heater). In some embodiments, the second exhaust aftertreatment system 24 may be integrated into the DEF doser 40. Additionally, in some embodiments, the intake heater 19 may be used in the controlled regeneration of the DOC 26, the SCR catalyst 34 and/or the AMOx catalyst 36.

The DOC 26 may have any of various flow-through designs. Generally, the DOC 26 is structured to oxidize at least some particulate matter, e.g., the soluble organic fraction of soot, in the exhaust and reduce unburned hydrocarbons (HC) and carbon monoxide (CO) in the exhaust to less environmentally harmful compounds. For example, the DOC 26 may be structured to reduce the HC and CO concentrations in the exhaust to meet the requisite emissions standards for those components of the exhaust gas. An indirect consequence of the oxidation capabilities of the DOC 26 is the ability of the DOC 26 to oxidize NO into $NO_2$. In this manner, the level of $NO_2$ the DOC 26 is equal to the $NO_2$ in the exhaust gas generated by the engine 16 plus the $NO_2$ converted from NO by the DOC 26.

In addition to treating the hydrocarbon and CO concentrations in the exhaust gas, the DOC 26 may also aid regeneration of the DPF 28, the SCR catalyst 34, and the AMOx catalyst 36. This can be accomplished through the injection, or dosing, of unburned HC into the exhaust gas upstream of the DOC 26. Upon contact with the DOC 26, the unburned HC undergoes an exothermic oxidation reaction, which leads to an increase in the temperature of the exhaust gas exiting the DOC 26 and subsequently entering the DPF 28, the SCR catalyst 34, and/or the AMOx catalyst 36. The amount of unburned HC added to the exhaust gas is selected to achieve the desired temperature increase or target controlled regeneration temperature.

The DPF 28 may be any of various flow-through or wall-flow designs, and is structured to reduce particulate matter concentrations, e.g., soot and ash, in the exhaust gas to meet or substantially meet requisite emission standards. The DPF 28 captures particulate matter and other constituents, and thus may need to be periodically regenerated to burn off the captured constituents. Additionally, the DPF 28 may be structured to oxidize NO to form $NO_2$ independent of the DOC 26.

As discussed above, the SCR system 32 may include a reductant delivery system with a reductant (e.g., DEF) source 38, a pump, and a delivery mechanism or doser 40. The reductant source 38 can be a container or tank capable of retaining a reductant, such as, for example, ammonia ($NH_3$), DEF (e.g., urea), or diesel oil. The reductant source 38 is in reductant supplying communication with the pump, which is structured to pump reductant from the reductant source 38 to the doser 40 via a reductant delivery line 42. The doser 40 may be positioned upstream of the SCR catalyst 34. The doser 40 is selectively controllable to inject reductant directly into the exhaust gas prior to entering the SCR catalyst 34. In some embodiments, the reductant may either be ammonia or DEF, which decomposes to produce ammonia. As briefly described above, the ammonia reacts with NOx in the presence of the SCR catalyst 34 to reduce the NOx to less harmful emissions, such as $N_2$ and $H_2O$. The NOx in the exhaust gas includes $NO_2$ and NO. Generally, both $NO_2$ and NO are reduced to $N_2$ and $H_2O$ through various chemical reactions driven by the catalytic elements of the SCR catalyst 34 in the presence of reductant such as $NH_3$.

Returning to FIG. 1, the SCR catalyst 34 may be any of various catalysts known in the art. For example, in some embodiments, the SCR catalyst 34 is a vanadium-based catalyst, and in other embodiments, the SCR catalyst 34 is a zeolite-based catalyst, such as a Cu-Zeolite or a Fe-Zeolite catalyst. In one representative embodiment, the DEF is aqueous urea and the SCR catalyst 34 is a vanadium-based catalyst.

The AMOx catalyst 36 may be any of various flow-through catalysts structured to react with ammonia to produce mainly nitrogen. As briefly described above, the AMOx catalyst 36 is structured to remove ammonia that has slipped through or exited the SCR catalyst 34 without reacting with NOx in the exhaust gas. In certain instances, the exhaust aftertreatment system 22 can be operable with or without the AMOx catalyst 36. Further, although the AMOx catalyst 36 is shown as a separate unit from the SCR catalyst 34 in FIG. 1, in some embodiments, the AMOx catalyst 36 may be integrated with the SCR catalyst 34, e.g., the AMOx catalyst 36 and the SCR catalyst 34 can be located within the same housing. In still other embodiments, the AMOx catalyst 36 may be excluded from the exhaust aftertreatment system 22.

Figure 5:
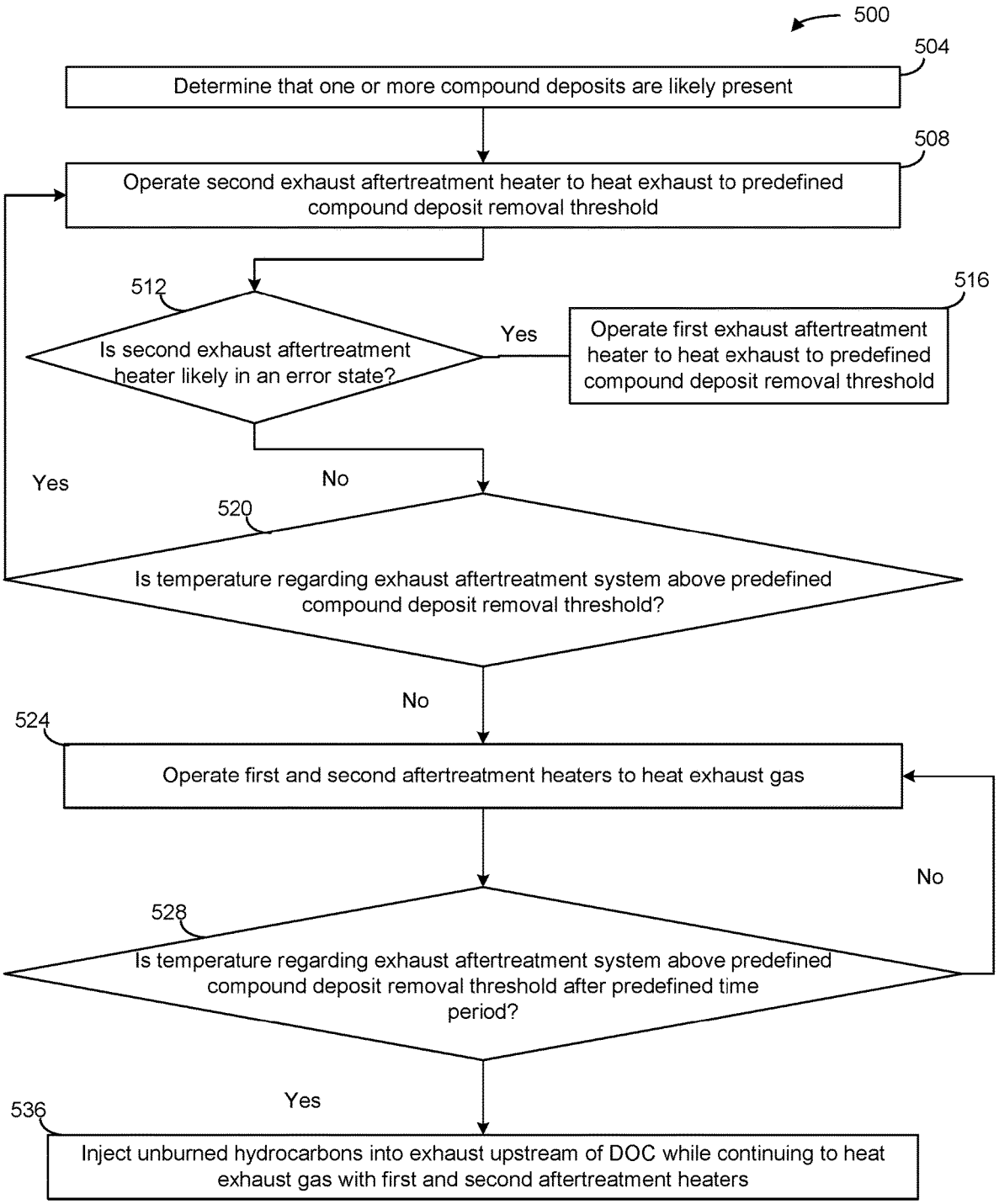
FIG. 5 is a flow diagram of a method for heating the exhaust aftertreatment system of FIG. 1 to mitigate a compound deposit according to an example embodiment.

Returning to FIG. 1, the exhaust aftertreatment system 22 may include various sensors, such as NOx sensors, temperature sensors, pressure sensors, and so on. The various sensors may be strategically disposed throughout the exhaust aftertreatment system 22 and may be in communication with the controller 14 to monitor operating conditions of the exhaust aftertreatment system 22 and/or the engine 16. As shown in FIG. 5, the exhaust aftertreatment system 22 includes a first NOx sensor 54 positioned at or upstream of the inlet of the SCR catalyst 34, a second NOx sensor 56 positioned at or downstream of the outlet of the SCR catalyst 34, one or more temperature sensors 59 at or proximate the SCR catalyst 34 and/or the AMOx catalyst 36 and one or more pressure sensors 58 positioned at or proximate the DPF 28. In some embodiments, the first NOx sensor 54 can be positioned at or downstream of the inlet of the exhaust aftertreatment system 22. In some embodiments, the second NOx sensor 56 can be positioned at or downstream of the outlet of the exhaust aftertreatment system 22.

The first NOx sensor 54 is structured to determine information indicative of a NOx concentration of the exhaust gas entering the exhaust aftertreatment system 22 and/or information indicative of a concentration of the exhaust gas upstream of the SCR catalyst 34. The second NOx sensor 56 is structured to determine information indicative of an outlet NOx concentration. As used herein, "outlet NOx concentration" means the NOx concentration of the exhaust gas exiting the SCR catalyst 34, the AMOx catalyst 36, or the exhaust aftertreatment system 22. The pressure sensor(s) 58 are structured to determine a pressure drop across the DPF 28. The one or more temperature sensors 59 are structured to determine one or more of a temperature of the exhaust gas at or proximate an inlet of the SCR catalyst 34, a temperature of a bed of the SCR catalyst 34, and/or a temperature of the exhaust gas at or proximate an outlet of the SCR catalyst 34. While FIG. 1 depicts several sensors (e.g., the first NOx sensor 54, the second NOx sensor 56, the pressure sensor 58, and the temperature sensor 59), it should be understood that one or more of these sensors may be replaced by virtual sensor in other embodiments. In this regard, the NOx amount at various locations may be estimated, determined, or otherwise correlated with various operating conditions of the engine 16 and exhaust aftertreatment system 22.

FIG. 1 is also shown to include an operator input/output (I/O) device 62. The operator I/O device 62 is communicably coupled to the controller 14, such that information may be exchanged between the controller 14 and the operator I/O device 62, wherein the information may relate to one or more components of FIG. 1 or determinations (described below) of the controller 14. The operator I/O device 62 enables an operator of the engine system 12 to communicate with the controller 14 and one or more components of the engine system 12 of FIG. 1. For example, the operator I/O device 62 may include, but is not limited to, an interactive display, a touchscreen device, one or more buttons and switches, voice command receivers, etc.

In various alternate embodiments, the controller 14 and components described herein may be implemented with non-vehicular applications (e.g., a power generator). Accordingly, the operator I/O device 62 may be specific to those applications. For example, in those instances, the operator I/O device 62 may include a laptop computer, a tablet computer, a desktop computer, a phone, a watch, a personal digital assistant, etc. Via the operator I/O device 62, the controller 14 may provide diagnostic information, a fault or service notification related to a status of the intake heater 19, the first aftertreatment heater 24, and the second aftertreatment heater 30.

The operator I/O device 62 may enable an operator of the vehicle 10 (or passenger or manufacturing, service, or maintenance personnel) to communicate with the vehicle 10 and the controller 14. By way of example, the operator I/O device 62 may include, but is not limited to, an interactive display, a touchscreen device, one or more buttons and switches, voice command receivers, and the like. In one embodiment, the operator I/O device 62 may display fault indicators to the operator of the vehicle.

Components of the vehicle 10 may communicate with each other or foreign components (e.g., a remote operator) using any type and any number of wired or wireless connections. Communication between and among the controller 14 and the components of the vehicle 10 may be via any number of wired or wireless connections (e.g., any standard under IEEE 802). For example, a wired connection may include a serial cable, a fiber optic cable, a CAT5 cable, or any other form of wired connection. Wireless connections may include the Internet, Wi-Fi, cellular, radio, Bluetooth, ZigBee, etc. In one embodiment, a controller area network (CAN) bus provides the exchange of signals, information, and/or data. The CAN bus includes any number of wired and wireless connections that provide the exchange of signals, information, and/or data. The CAN bus may include a local area network (LAN), or a wide area network (WAN), or the connection may be made to an external computer (for example, through the Internet using an Internet Service Provider). Because the controller 14 is communicably coupled to the systems and components in the vehicle 10 of FIG. 1, the controller 14 is structured to receive data regarding one or more of the components shown in FIG. 1. For example, the data may include operation data regarding the operating conditions of the engine 16, the reductant doser 40, the SCR catalyst 34 and/or other components (e.g., a battery system, a motor, a generator, a regenerative braking system) acquired by one or more sensors.

As the components of FIG. 1 are shown to be embodied in the engine system 12, the controller 14 may be structured as one or more electronic control units (ECU). The controller 14 may be separate from or included with at least one of a transmission control unit, an exhaust aftertreatment control unit, a powertrain control circuit, an engine control circuit, etc. The function and structure of the controller 14 is described in greater detail in FIG. 2.

Figure 2:
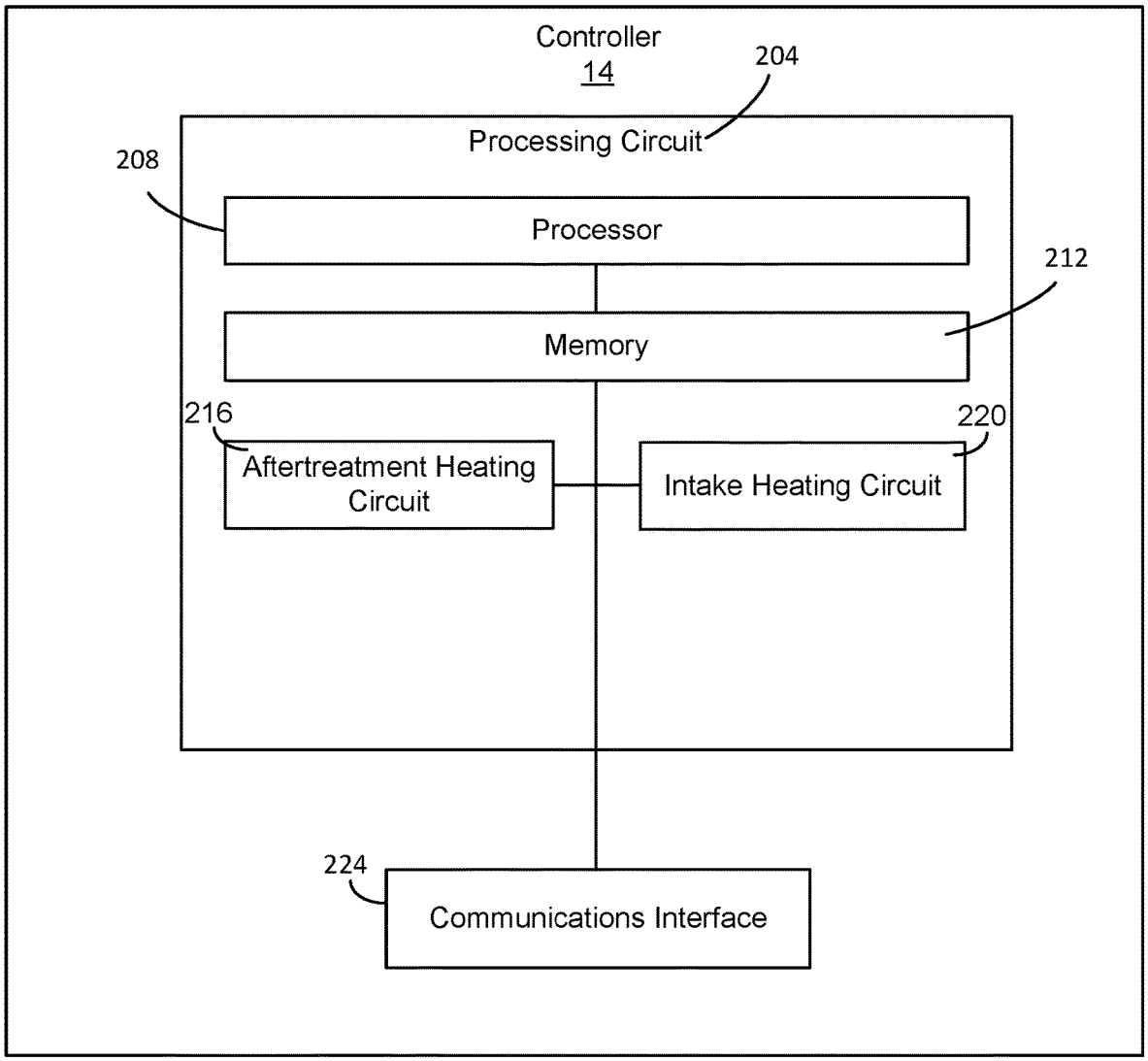
FIG. 2 is a schematic diagram of the controller of the system of FIG. 1 according to an example embodiment.

Referring now to FIG. 2, a schematic diagram of the controller 14 of the vehicle 10 of FIG. 1 is shown according to an example embodiment. As shown in FIG. 2, the controller 14 includes a processing circuit 204 having a processor 208 and a memory device 212, an aftertreatment heating circuit 216, an intake heating circuit 220, and the communications interface 224. The controller 14 is structured to compare a temperature regarding the exhaust aftertreatment system 22 to a predefined aftertreatment temperature threshold. In response to determining that the temperature regarding the exhaust aftertreatment system 22 is below the predefined aftertreatment temperature threshold, the controller 14 is structured to command one or more of the engine 16, the intake heater 19, the first aftertreatment heater 24, and/or the second aftertreatment heater 30 to increase a temperature of the exhaust aftertreatment system 22. The controller is structured to control one or more of the engine 16, the intake heater 19, the first aftertreatment heater 24, and the second aftertreatment heater 30 to heat the exhaust gas and/or exhaust aftertreatment system 22, based on one or more of a characteristic of the battery and a likelihood that the first aftertreatment heater 24 and/or the second aftertreatment heater 30 is in an error state.

In one configuration, the aftertreatment heating circuit 216 and the intake heating circuit 220, are embodied as machine or computer-readable media that is executable by a processor, such as the processor 208. As described herein and amongst other uses, the machine-readable media facilitates performance of certain operations to enable reception and transmission of data. For example, the machine-readable media may provide an instruction (e.g., command) to, e.g., acquire data. In this regard, the machine-readable media may include programmable logic that defines the frequency of acquisition of the data (or, transmission of the data). The computer readable media may include code, which may be written in any programming language including, but not limited to, Java or the like and any conventional procedural programming languages, such as the "C" programming language or similar programming languages. The computer readable program code may be executed on one processor or multiple remote processors. In the latter scenario, the remote processors may be connected to each other through any type of network (e.g., CAN bus).

In another configuration, the aftertreatment heating circuit 216 and the intake heating circuit 220 may be embodied as one or more circuitry components including, but not limited to, processing circuitry, network interfaces, peripheral devices, input devices, output devices, sensors, etc. In some embodiments, the aftertreatment heating circuit 216 and the intake heating circuit 220 may take the form of one or more analog circuits, electronic circuits (e.g., integrated circuits (IC), discrete circuits, system on a chip (SOCs) circuits, microcontrollers), telecommunication circuits, hybrid circuits, and any other type of circuit. In this regard, the aftertreatment heating circuit 216 and the intake heating circuit 220 may include any type of component for accomplishing or facilitating achievement of the operations described herein. For example, a circuit as described herein may include one or more transistors, logic gates (e.g., NAND, AND, NOR, OR, XOR, NOT, XNOR), resistors, multiplexers, registers, capacitors, inductors, diodes, wiring, and so on). The aftertreatment heating circuit 216 and the intake heating circuit 220 may also include programmable hardware devices such as field programmable gate arrays, programmable array logic, programmable logic devices or the like. The aftertreatment heating circuit 216 and the intake heating circuit 220 may include one or more memory devices for storing instructions that are executable by the processor(s) of the aftertreatment heating circuit 216 and the intake heating circuit 220. The one or more memory devices and processor(s) may have the same definition as provided below with respect to the memory device 212 and the processor 208. In some hardware unit configurations, the aftertreatment heating circuit 216 and the intake heating circuit 220 may be geographically dispersed throughout separate locations in the vehicle. Alternatively and as shown, the aftertreatment heating circuit 216 and the intake heating circuit 220 may be embodied in or within a single unit/housing, which is shown as the controller 14.

In the example shown, the controller 14 includes a processing circuit 204 having the processor 208 and the memory device 212. The processing circuit 204 may be structured or configured to execute or implement the instructions, commands, and/or control processes described herein with respect to the aftertreatment heating circuit 216 and the intake heating circuit 220. The depicted configuration represents the aftertreatment heating circuit 216 and the intake heating circuit 220 as machine or computer-readable media. However, as mentioned above, this illustration is not meant to be limiting as the present disclosure contemplates other embodiments where the aftertreatment heating circuit 216 and the intake heating circuit 220 or at least one circuit of the aftertreatment heating circuit 216 and the intake heating circuit 220 is configured as a hardware unit. All such combinations and variations are intended to fall within the scope of the present disclosure.

The processor 208 may be implemented as one or more general-purpose processor, an application specific integrated circuit (ASIC), one or more field programmable gate arrays (FPGAs), a digital signal processor (DSP), a group of processing components, or other suitable electronic processing components. In some embodiments, the one or more processors may be shared by multiple circuits (e.g., the aftertreatment heating circuit 216 and the intake heating circuit 220 may comprise or otherwise share the same processor which, in some example embodiments, may execute instructions stored, or otherwise accessed, via different areas of memory). Alternatively or additionally, the one or more processors may be structured to perform or otherwise execute certain operations independent of one or more co-processors. In other example embodiments, two or more processors may be coupled via a bus to enable independent, parallel, pipelined, or multi-threaded instruction execution. All such variations are intended to fall within the scope of the present disclosure. The memory device 212 (e.g., RAM, ROM, Flash Memory, hard disk storage) may store data and/or computer code for facilitating the various processes described herein. The memory device 212 may be communicably coupled to the processor 208 to provide computer code or instructions to the processor 208 for executing at least some of the processes described herein. Moreover, the memory device 212 may be or include tangible, non-transient volatile memory or non-volatile memory. Accordingly, the memory device 212 may include database components, object code components, script components, or any other type of information structure for supporting the various activities and information structures described herein.

The communications interface 224 may include wired or wireless interfaces (e.g., jacks, antennas, transmitters, receivers, transceivers, wire terminals) for conducting data communications with various systems, devices, or networks. For example, the communications interface 224 may include an Ethernet card and port for sending and receiving data via an Ethernet-based communications network and/or a Wi-Fi transceiver for communicating via a wireless communications network. The communications interface 224 may be structured to communicate via local area networks or wide area networks (e.g., the Internet) and may use a variety of communications protocols (e.g., IP, LON, Bluetooth, ZigBee, radio, cellular, near field communication).

The communications interface 224 of the controller 14 may facilitate communication between and among the controller 14 and one or more components of the vehicle 10 (e.g., the engine 16, the exhaust aftertreatment system 22, the NOx sensors 54, 56, the pressure sensor(s) 58, and the temperature sensor(s) 59).

The aftertreatment heating circuit 216 is structured to receive information indicative of a temperature regarding the exhaust aftertreatment system 22. The information indicative of the temperature regarding the exhaust aftertreatment system 22 may be a temperature of the exhaust gas flowing through the exhaust aftertreatment system 22 and/or a temperature of a component or components of the exhaust aftertreatment system 22, such as a temperature of the SCR catalyst 34. The information indicative of the temperature regarding the exhaust aftertreatment system 22 may include an exhaust gas temperature sensed by the temperature sensor(s) 59, a temperature of one or more components of the exhaust aftertreatment system 22, a NOx conversion efficiency, an ambient air temperature (e.g., when the engine 16 is operating under cold start conditions), an exhaust gas temperature at or proximate the engine exhaust manifold 20, an engine coolant temperature, an engine out exhaust gas temperature and so on. The temperature of one or more components of the exhaust aftertreatment system may include a temperature of the SCR catalyst 34, a temperature of the DOC 26, a temperature of the DPF 28, and/or a temperature of one or more of the reductant dosers 40. In such embodiments, one or more temperature sensors may be coupled to the SCR catalyst 34, the DOC 26, the DPF 28, and/or the reductant dosers 40. The NOx conversion efficiency may be determined based on a difference between the inlet and outlet NOx concentrations determined by the inlet and outlet NOx sensors 54, 56. The NOx conversion efficiency may be an indicator of the temperature of the exhaust gas and/or component(s) of the exhaust aftertreatment system 22. Lower NOx conversion efficiencies may correspond with lower catalyst, particularly SCR catalyst 34, temperatures because low SCR catalyst 34 temperatures correspond with lower efficacy of the SCR catalyst 34. In some embodiments, the aftertreatment heating circuit 216 may be structured to determine the temperature regarding the exhaust aftertreatment system 22 based on the information indicative of the exhaust aftertreatment system 22 using a look-up table, an algorithm, and so on. In some embodiments, the aftertreatment heating circuit 216 may be structured to determine an aftertreatment system heating time period based on the information indicative of the temperature of the exhaust aftertreatment system 22 using a look-up table, an algorithm, and so on. In such embodiments, the aftertreatment heating circuit 216 may be structured to heat the exhaust aftertreatment system 22 for the aftertreatment system heating time period. The heating time period refers to an amount of time that the first aftertreatment heater 24 and/or the second aftertreatment heater 30 are operated to heat the exhaust aftertreatment system 22 to raise the temperature regarding the exhaust aftertreatment system 22 to a predefined temperature threshold. The predefined threshold is a temperature or a range of temperatures at which the exhaust aftertreatment system 22 and/or components of the exhaust aftertreatment system 22 such as the SCR catalyst 34 and/or the AMOx catalyst 36 operate efficiently (e.g., above 200° C.).

The aftertreatment heating circuit 216 is structured to determine the temperature regarding the exhaust aftertreatment system 22 based on the information indicative of the temperature regarding the exhaust aftertreatment system 22. The aftertreatment heating circuit 216 is structured to compare the temperature regarding the exhaust aftertreatment system 22 to the predefined temperature threshold. In response to determining that the temperature regarding the exhaust aftertreatment system 22 is at or above the predefined temperature threshold, the aftertreatment heating circuit 216 is structured to determine that the exhaust aftertreatment system 22 is unlikely to benefit from heating. In response to determining that the temperature regarding the exhaust aftertreatment system 22 is below the predefined threshold, the aftertreatment heating circuit 216 determines that the exhaust aftertreatment system 22 should be heated.

The aftertreatment heating circuit 216 is structured to receive information indicative of a characteristic of the battery 17. The characteristic of the battery 17 may include one or more of a state of charge (SOC) of the battery 17, a state of health (SOH) of the battery 17, and a voltage of the battery 17. The aftertreatment heating circuit 216 is structured to compare the characteristic of the battery 17 to a first predefined battery characteristic threshold. The first predefined battery characteristic threshold may be one or more of a SOC threshold, a SOH threshold, and a voltage threshold indicating that the battery 17 can power the first aftertreatment heater 24 for at least a predefined time period. In certain situations as described herein and in response to determining that the characteristic of the battery 17 is below the first predefined battery threshold, the aftertreatment heating circuit 216 is structured to control the temperature regarding the exhaust aftertreatment system 22 without using the first or second aftertreatment heaters 24, 30. Controlling the temperature regarding the exhaust aftertreatment system 22 without using the first or second aftertreatment heaters 24, 30 may include one or more of changing engine operations, HC dosing, post-fuel injection, or manipulation of charge air to increase a temperature of the exhaust gas. For example, when changing engine operations, the aftertreatment heating circuit 216 may increase a load of the engine 16, a speed of the engine 16, and/or deactivate one or more cylinders of the engine 16 to increase a temperature of the exhaust gas. Post-fuel injection includes injecting fuel into the engine cylinders after the injection of the fuel that combusted during the combustion stroke of the cylinder. The fuel added via post-fuel injection does not burn inside the engine cylinders. Instead, the fuel travels to the exhaust aftertreatment system 22 with the exhaust gas. The fuel undergoes an exothermic reaction across the DOC 26, increasing a temperature of the exhaust gas. Manipulation of the charge air includes bypassing charge air coolers when directing charge air into the engine cylinders. This results in higher temperature combustion and higher temperature exhaust gas exiting the engine 16. The aftertreatment heating circuit 216 does not activate the first aftertreatment heater 24 or the second aftertreatment heater 30. In this regard, an available amount of battery power is below a predefined threshold such that additional draining of the battery 17 to power the first or second heaters 24 and 30 are bypassed.

In response to determining that the characteristic of the battery 17 at or above the first predefined battery characteristic threshold, the aftertreatment heating circuit 216 is structured to compare the characteristic of the battery 17 to a second predefined battery characteristic threshold. The second predefined battery characteristic threshold indicates that the battery 17 can provide more power than the battery 17 can when the battery 17 is below the first predefined battery characteristic threshold. The second predefined battery characteristic threshold may be one or more of a SOC threshold, a SOH threshold, and a voltage threshold indicating that the battery 17 can power both the first aftertreatment heater 24 and the second aftertreatment heater 30 for at least a predefined time period.

In response to determining that the characteristic of the battery 17 is at or above the first predefined battery characteristic threshold and below the second predefined battery characteristic threshold, the aftertreatment heating circuit 216 is structured to operate the first aftertreatment heater 24 to increase a temperature of the exhaust gas flowing through the exhaust aftertreatment system 22. In some embodiments, the aftertreatment heating circuit 216 is structured modulate an amount of heat provided by the first aftertreatment heater 24 based on the characteristic of the battery 17. For example, the aftertreatment heating circuit 216 may reduce an output, a power consumption, and/or a load of the first aftertreatment heater 24. In some embodiments, the aftertreatment heating circuit 216 may also change engine operations to increase a temperature of the exhaust gas. For example, the aftertreatment heating circuit 216 may be structured to change engine operations, HC dosing, post-fuel injection, and/or manipulate the charge air to increase a temperature of the exhaust gas.

In response to determining that the characteristic of the battery 17 is above the second battery threshold, the aftertreatment heating circuit 216 may use both the first aftertreatment heater 24 and the second aftertreatment heater 30 to heat the exhaust gas.

For example, in some conditions the engine 16 may be starting from a cold start. As used herein, the phrase "cold start" refers to starting the engine 16 after the engine 16 has been turned off for a period of time such that a temperature of the engine 16 is substantially equal to that of the outside or ambient outside temperature. Thus, in very cold situations (e.g., below the freezing temperature of water), the engine 16, and therefore the exhaust aftertreatment system 22 (including the SCR catalyst 34), are similarly cold, which means increasing the temperature to help promote efficiency is especially important to the operational ability of the SCR catalyst 34 in the vehicle 10. Under cold start conditions, heating the engine 16 and the components of the exhaust aftertreatment system 22 with the engine exhaust gas takes more time and energy relative to an amount of time and energy to heat an engine 16 and an exhaust aftertreatment system 22 that are warm. The phrase "warm" generally refers to conditions in which the engine 16 has been turned off, but the engine 16 and the exhaust aftertreatment system 22 are not substantially equal to the ambient or ambient outside temperature. The aftertreatment heating circuit 216 may be structured to determine that the engine 16 is warm based on determining that the engine temperature is above a predefined engine temperature threshold, a coolant temperature is above a predefined coolant temperature threshold, an oil temperature is above a predefined oil temperature threshold, and/or an oil pressure is above a predefined oil pressure threshold.

In embodiments in which the engine 16 is starting from a cold start, the aftertreatment heating circuit 216 is structured to use both the first aftertreatment heater 24 and the second aftertreatment heater 30 to heat the exhaust gas until the temperature regarding the exhaust aftertreatment system 22 has reached a predefined threshold. The aftertreatment heating circuit 216 may then turn off the second aftertreatment heater 30 and use the first aftertreatment heater 24 for thermal management. In another example, the aftertreatment heating circuit 216 may be structured to continue heating the exhaust gas with the first aftertreatment heater 24. In response to determining that a temperature regarding the exhaust aftertreatment system 22 has not reached a predefined temperature threshold after a predefined time period, the aftertreatment heating circuit 216 is structured to use the second aftertreatment heater 30 in conjunction with the first aftertreatment heater 24 to heat the exhaust gas.

The aftertreatment heating circuit 216 may receive information indicating that the first aftertreatment heater 24 may be in an error state. Conditions that establish the error state may include one or more fault codes, determining that a temperature downstream of the first aftertreatment heater 24 is not increasing, and/or a voltage and/or a current going through the first aftertreatment heater 24. In such conditions, the aftertreatment heating circuit 216 is structured to operate the second aftertreatment heater 30 as described above with respect to the first aftertreatment heater 24 instead of using the first aftertreatment heater 24.

Figure 3:
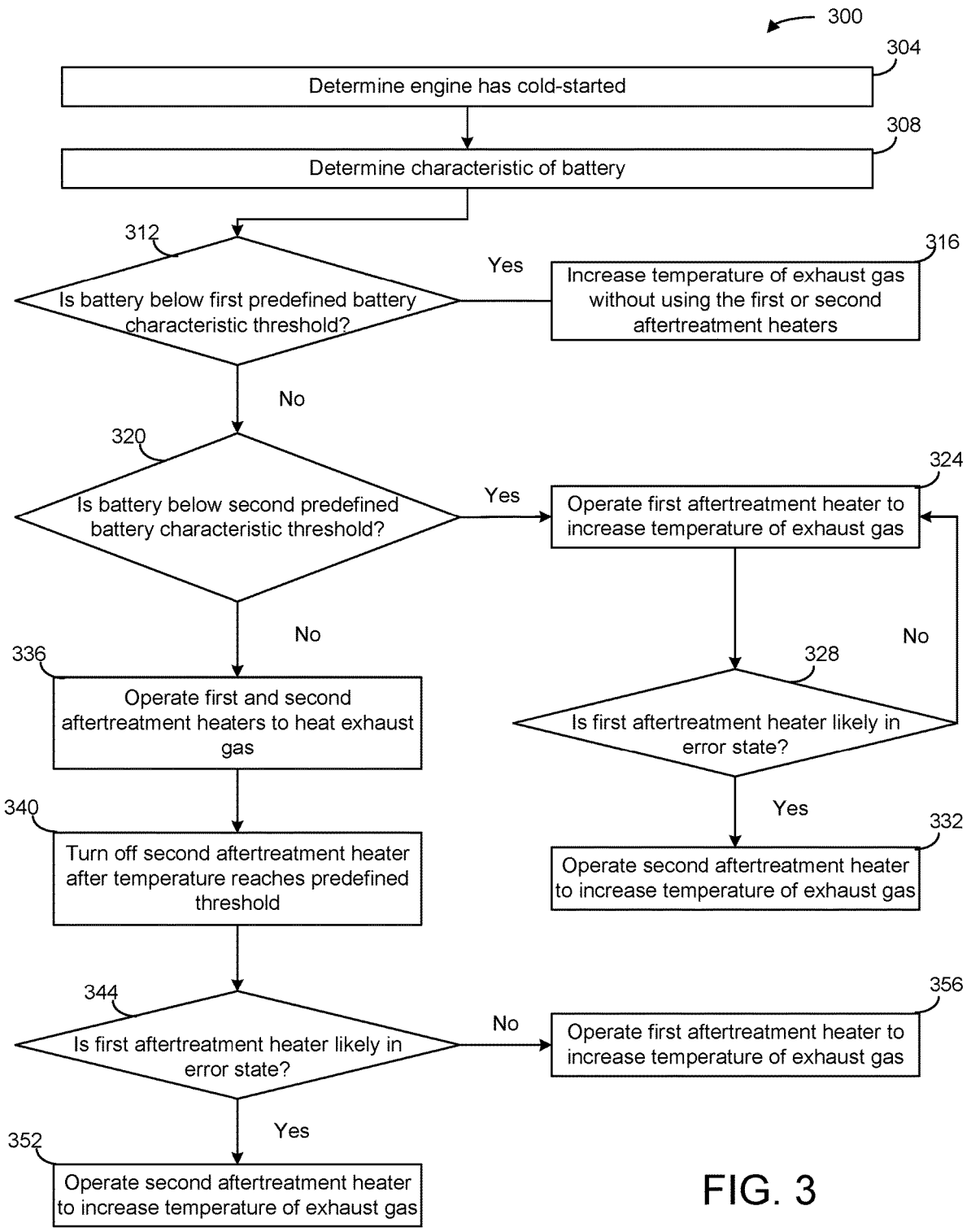
FIG. 3 is a flow diagram of a method for heating the exhaust aftertreatment system of FIG. 1 after a cold start according to an example embodiment.

FIG. 3 illustrates an exemplary method 300 for heating an exhaust aftertreatment system after a cold start according to an exemplary embodiment. The method 300 initiates in response to the aftertreatment heating circuit 216 determining that the engine 16 is undergoing a cold start, at process 304. At process 308, the aftertreatment heating circuit 216 determines the characteristic of the battery 17 based on information indicative of the characteristic of the battery 17. At process 312, the aftertreatment heating circuit 216 compares the characteristic of the battery 17 to the first predefined battery characteristic threshold. The first predefined battery characteristic threshold may be one or more of a SOC threshold, a SOH threshold, and a voltage threshold indicating that the battery 17 can power the first aftertreatment heater 24 for at least a predefined time period. At process 316, in response to determining that the characteristic of the battery 17 is below the first predefined battery characteristic threshold, the aftertreatment heating circuit 216 increases the temperature of the exhaust gas without using the first or second aftertreatment heaters 24, 30. For example, the aftertreatment heating circuit 216 may change engine operations, HC dosing, post-fuel injection, and/or manipulate the charge air to increase a temperature of the exhaust gas. The aftertreatment heating circuit 216 does not power the first aftertreatment heater 24 or the second aftertreatment heater 30.

At process 320, in response to determining that the characteristic of the battery 17 is at or above the first predefined battery characteristic threshold, the aftertreatment heating circuit 216 compares the characteristic of the battery 17 to a second predefined battery characteristic threshold. The second predefined battery characteristic threshold is higher than the first predefined battery characteristic threshold. The second predefined battery characteristic threshold may be one or more of a SOC threshold, a SOH threshold, and a voltage threshold indicating that the battery 17 can power both the first aftertreatment heater 24 and the second aftertreatment heater 30 for at least a predefined time period.

At process 324, in response to determining that the characteristic of the battery 17 is at or above the first predefined battery characteristic threshold and below the second predefined battery characteristic threshold, the aftertreatment heating circuit 216 operates the first aftertreatment heater 24 to increase a temperature of the exhaust gas flowing through the exhaust aftertreatment system 22. In some embodiments, the aftertreatment heating circuit 216 may modulate an amount of heat provided by the first aftertreatment heater 24 based on the characteristic of the battery 17. For example, the aftertreatment heating circuit 216 may reduce an output, a load, and/or a power consumption of the first aftertreatment heater 24. In some embodiments, the aftertreatment heating circuit 216 may also may change engine operations, HC dosing, post-fuel injection, and/or manipulate the charge air to increase a temperature of the exhaust gas.

At process 328, the aftertreatment heating circuit 216 determines a likelihood that the first aftertreatment heater 24 is in an error state. At process 332, in response to determining that the first aftertreatment heater 24 is likely in an error state, the aftertreatment heating circuit 216 operates the second aftertreatment heater 30 to increase the temperature of the exhaust gas flowing through the exhaust aftertreatment system 22 as described above with respect to process 324.

At process 336, in response to determining that the characteristic of the battery is above the second battery threshold, the aftertreatment heating circuit 216 may use both the first aftertreatment heater 24 and the second aftertreatment heater 30 to heat the exhaust gas. At process 340, the aftertreatment heating circuit 216 turns off the second aftertreatment heater 30 in response to determining that the temperature regarding the exhaust aftertreatment system 22 has reached a predefined threshold. The aftertreatment heating circuit 216 may continue to use the first aftertreatment heater 24 for thermal management.

At process 344, the aftertreatment heating circuit 216 determines a likelihood that the first aftertreatment heater 24 is in an error state. At process 348, in response to determining that the first aftertreatment heater 24 is likely in an error state, the aftertreatment heating circuit 216 operates the second aftertreatment heater 30 for thermal management. At process 352, in response to determining that the first aftertreatment heater 24 is unlikely in an error state, the aftertreatment heating circuit 216 operates the first aftertreatment heater 24 for thermal management.

Figure 4:
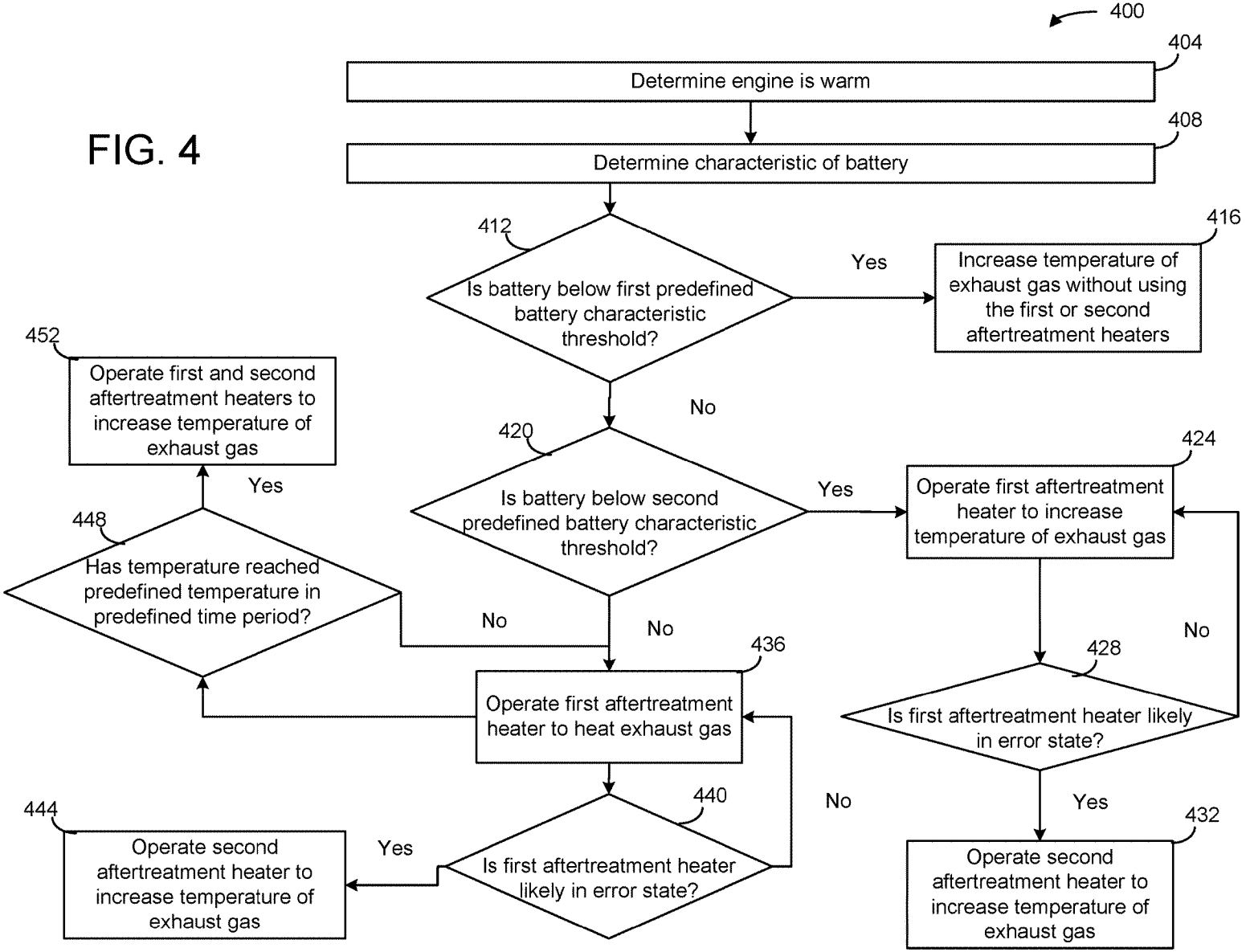
FIG. 4 is a flow diagram of a method for heating the exhaust aftertreatment system of FIG. 1 according to another example embodiment.

FIG. 4 illustrates an exemplary method 400 for heating an exhaust aftertreatment system 22 according to an exemplary embodiment. The method 400 initiates in response to the aftertreatment heating circuit 216 determining that the engine 16 is warm (e.g., not a cold start condition), at process 404. At process 408, the aftertreatment heating circuit 216 determines the characteristic of the battery 17 based on information indicative of the characteristic of the battery 17. At process 412, the aftertreatment heating circuit 216 compares the characteristic of the battery 17 to the first predefined battery characteristic threshold. The first predefined battery characteristic threshold may be one or more of a SOC threshold, a SOH threshold, and a voltage threshold indicating that the battery 17 can power the first aftertreatment heater 24 for at least a predefined time period. At process 416, in response to determining that the characteristic of the battery 17 is below the first predefined battery threshold, the aftertreatment heating circuit 216 increases a temperature of the exhaust gas without using the first or second aftertreatment heaters 24, 40. For example, the aftertreatment heating circuit 216 may change engine operations, HC dosing, post-fuel injection, and/or manipulate the charge air to increase a temperature of the exhaust gas. The aftertreatment heating circuit 216 does not power the first aftertreatment heater 24 or the second aftertreatment heater 30.

At process 420, in response to determining that the characteristic of the battery 17 is at or above the first predefined battery characteristic threshold, the aftertreatment heating circuit 216 compares the characteristic of the battery 17 to a second predefined battery characteristic threshold. The second predefined battery characteristic threshold is higher than the first predefined battery characteristic threshold. The second predefined battery characteristic threshold may be one or more of a SOC threshold, a SOH threshold, and a voltage threshold indicating that the battery 17 can power both the first aftertreatment heater 24 and the second aftertreatment heater 30 for at least a predefined time period.

At process 424, in response to determining that the characteristic of the battery is at or above the first predefined battery characteristic threshold and below the second predefined battery characteristic threshold, the aftertreatment heating circuit 216 operates the first aftertreatment heater 24 to increase a temperature of the exhaust gas flowing through the exhaust aftertreatment system 22. In some embodiments, the aftertreatment heating circuit 216 may modulate an amount of heat provided by the first aftertreatment heater 24 based on the characteristic of the battery 17. For example, the aftertreatment heating circuit 216 may reduce an output, a power consumption, and/or a load of the first aftertreatment heater 24. In some embodiments, the aftertreatment heating circuit 216 may also change engine operations, HC dosing, post-fuel injection, and/or manipulate the charge air to increase a temperature of the exhaust gas.

At process 428, the aftertreatment heating circuit 216 determines a likelihood that the first aftertreatment heater 24 is in an error state. For example, the aftertreatment heating circuit 216 may determine that the first aftertreatment heater 24 is in a fault state based on a fault code, by determining that a temperature downstream of the first aftertreatment heater 24 is not increasing, and/or based on a voltage and/or a current going through the first aftertreatment heater 24. At process 432, in response to determining that the first aftertreatment heater 24 is likely in an error state, the aftertreatment heating circuit 216 operates the second aftertreatment heater 30 to increase the temperature of the exhaust gas flowing through the exhaust aftertreatment system 22 as described above with respect to process 424.

At process 436, in response to determining that the characteristic of the battery 17 is above the second battery threshold, the aftertreatment heating circuit 216 uses the first aftertreatment heater 24 to heat the exhaust gas. At process 440, the aftertreatment heating circuit 216 determines a likelihood that the first aftertreatment heater 24 is in an error state. At process 444, in response to determining that the first aftertreatment heater 24 is likely in an error state, the aftertreatment heating circuit 216 operates the second aftertreatment heater 30 to increase the temperature of the exhaust gas flowing through the exhaust aftertreatment system 22 as described above with respect to process 436.

At process 448, the aftertreatment heating circuit 216 determines whether the temperature regarding the exhaust aftertreatment system 22 has reached a predefined temperature threshold in after a predefined time period. At process 452, in response to determining that the temperature regarding the exhaust aftertreatment system 22 has not reached a predefined temperature threshold after a predefined time period, the aftertreatment heating circuit 216 heats the exhaust gas using both the first aftertreatment heater 24 and the second aftertreatment heater 30.

In some embodiments, the aftertreatment heating circuit 216 may be structured to use the second aftertreatment heater 30 and/or the first aftertreatment heater 24 to mitigate compound deposits in the exhaust aftertreatment system 22. The compound deposits may be reductant deposits. In such embodiments, the aftertreatment heating circuit 216 is structured to determine that a compound deposit is likely present. In some instances, the compound deposit may be upstream of the SCR (e.g., proximate the DEF dosers 40). For example, the aftertreatment heating circuit 216 may receive information indicative of a pressure regarding the exhaust aftertreatment system 22 and determine that a compound deposit is likely present based on the pressure regarding the exhaust aftertreatment system 22. In some embodiments, the aftertreatment heating circuit 216 may determine that a compound deposit is likely present in response to determining that the pressure regarding the exhaust aftertreatment system 22 has been above a predefined pressure threshold for a predefined time period. In some embodiments, the aftertreatment heating circuit 216 may determine that one or more compound deposits are likely present based on a NOx conversion efficiency of the exhaust aftertreatment system 22.

The aftertreatment heating circuit 216 is structured to activate the second aftertreatment heater 30 to heat the exhaust gas to a predefined compound deposit removal temperature threshold. The aftertreatment heating circuit 216 is structured to compare the temperature regarding the exhaust aftertreatment system 22 to the predefined compound deposit removal temperature threshold after a predefined time period. In response to determining that the temperature regarding the exhaust aftertreatment system 22 is at or above the predefined compound deposit removal temperature threshold, the aftertreatment heating circuit 216 continues heating the exhaust gas using the second aftertreatment heater 30. The aftertreatment heating circuit 216 may receive information indicating that the second aftertreatment heater 30 is likely in an error state. Conditions that establish the error state may include one or more fault codes, determining that a temperature downstream of the second aftertreatment heater 30 is not increasing, and/or a voltage and/or a current going through the second aftertreatment heater 30. In such conditions, the aftertreatment heating circuit 216 is structured to operate the first aftertreatment heater 24 as described above with respect to the second aftertreatment heater 30 instead of using the second aftertreatment heater 30.

In response to determining that the temperature regarding the exhaust aftertreatment system 22 is below the predefined compound deposit removal temperature threshold, the aftertreatment heating circuit 216 is structured to activate the first aftertreatment heater 24 to assist the second aftertreatment heater 30. The aftertreatment circuit 216 heats the exhaust gas with both the first aftertreatment heater 24 and the second aftertreatment heater 30 to mitigate the compound deposit. The aftertreatment heating circuit 216 is structured to compare the temperature regarding the exhaust aftertreatment system 22 to the predefined compound deposit removal temperature threshold after a predefined time period. In response to determining that the temperature regarding the exhaust aftertreatment system 22 is at or above the predefined compound deposit removal temperature threshold, the aftertreatment heating circuit 216 continues heating the exhaust gas using the first aftertreatment heater 24 and the second aftertreatment heater 30. In response to determining that the temperature regarding the exhaust aftertreatment system 22 is at or above the predefined compound deposit removal temperature threshold, the aftertreatment heating circuit 216 continues heating the exhaust gas using the first aftertreatment heater 24 and the second aftertreatment heater 30 and introduces unburned hydrocarbons (HCs) into the exhaust gas upstream of the DOC 26 to assist the first and second aftertreatment heaters 24, 30 in heating the exhaust gas. Introducing unburned HCs into the exhaust gas upstream of the DOC 26 creates an exothermic oxidation reaction across the DOC 26 and increases a temperature of the exhaust gas to mitigate the compound deposit.

FIG. 5 illustrates an exemplary method 500 for heating the exhaust aftertreatment system 22 to mitigate one or more compound deposits according to an exemplary embodiment. At process 504, the aftertreatment heating circuit 216 determines that one or more compound deposit is likely present. For example, the aftertreatment heating circuit 216 may receive information indicative of a pressure regarding the exhaust aftertreatment system 22 and determine that that a compound deposit is likely present based on the pressure regarding the exhaust aftertreatment system 22.

At process 508, the aftertreatment heating circuit 216 activates the second aftertreatment heater 30 to heat the exhaust gas to a predefined compound deposit removal temperature threshold. At process 512, the aftertreatment heating circuit 216 determines a likelihood that the second aftertreatment heater 30 is in an error state. At process 516, in response to determining that the second aftertreatment heater 30 is likely in an error state, the aftertreatment heating circuit 216 activates the first aftertreatment heater 24 to heat the exhaust to the predefined compound deposit removal temperature threshold.

At process 520, the aftertreatment heating circuit 216 compares the temperature regarding the exhaust aftertreatment system 22 to the predefined compound deposit removal temperature threshold after a predefined time period. In response to determining that the temperature regarding the exhaust aftertreatment system 22 is at or above the predefined compound deposit removal temperature threshold, the aftertreatment heating circuit 216 continues heating the exhaust gas using the second aftertreatment heater 30.

At process 524, in response to determining that the temperature regarding the exhaust aftertreatment system 22 is below the predefined compound deposit removal temperature threshold, the aftertreatment heating circuit 216 is structured to activate the first aftertreatment heater 24 and heat the exhaust gas with both the first aftertreatment heater 24 and the second aftertreatment heater 30 to mitigate the compound deposit.

At process 528, the aftertreatment heating circuit 216 compares the temperature regarding the exhaust aftertreatment system 22 to the predefined compound removal temperature after a predefined time period. In response to determining that the temperature regarding the exhaust aftertreatment system 22 is at or above the predefined compound deposit removal temperature threshold, the aftertreatment heating circuit 216 continues heating the exhaust gas using the first aftertreatment heater 24 and the second aftertreatment heater 30.

At 532, in response to determining that the temperature regarding the exhaust aftertreatment system 22 is still below the predefined compound removal temperature after a predefined time period, the aftertreatment heating circuit 216 continues heating the exhaust gas using the first aftertreatment heater 24 and the second aftertreatment heater 30 and introduces unburned HCs into the exhaust upstream of the DOC 26, creating an exothermic reaction across the DOC 26 and increasing a temperature of the exhaust gas to mitigate the compound deposit.

In some embodiments, the aftertreatment heating circuit 216 may be structured to use the first aftertreatment heater 24 to regenerate the DPF 28 either independently or in conjunction with producing exhaust gas at a desired DPF regeneration temperature without using the first aftertreatment heater 24. Producing exhaust at the desired DPF regeneration temperature without using the first aftertreatment heater 24 may include one or more of changing engine operations, HC dosing, post-fuel injection, or manipulation of charge air to increase a temperature of the exhaust gas. In such embodiments, the aftertreatment heating circuit 216 is structured to receive information indicative of a state of the DPF 28. Information indicative of the state of the DPF 28 may include a pressure drop across the DPF 28, a pressure regarding the DPF 28, predicted DPF 28 soot loading, and/or expiration of a timer. The predicted DPF 28 soot loading may be determined based on a model, a look-up table, an algorithm, that may predict DPF 28 soot loading based on fuel consumption, combustion conditions of the engine 16, an amount of soot in the exhaust gas, etc. The aftertreatment heating circuit 216 is structured to determine a likelihood that the DPF 28 is in need of regeneration based on the information indicative of the state of the DPF 28. In response to determining that the DPF 28 is likely in need of regeneration, the aftertreatment heating circuit 216 is structured to receive information regarding a temperature of the DOC 26. The aftertreatment heating circuit 216 is structured to compare the information regarding the temperature of the DOC 26 to a predefined HC oxidation threshold. In response to determining that the temperature regarding the DOC 26 is above the predefined HC oxidation threshold, the aftertreatment heating circuit 216 is structured to command injection of unburned HC into the exhaust gas upstream of the DOC 26, creating an exothermic reaction across the DOC 26 and increasing a temperature of the exhaust gas to regenerate the DPF 28.

In response to determining that the temperature regarding the DOC 26 is less than or equal to the predefined HC oxidation threshold, the aftertreatment heating circuit 216 is structured to activate the first aftertreatment heater 24 to heat the exhaust gas to the predefined HC oxidation threshold.

Figure 6:
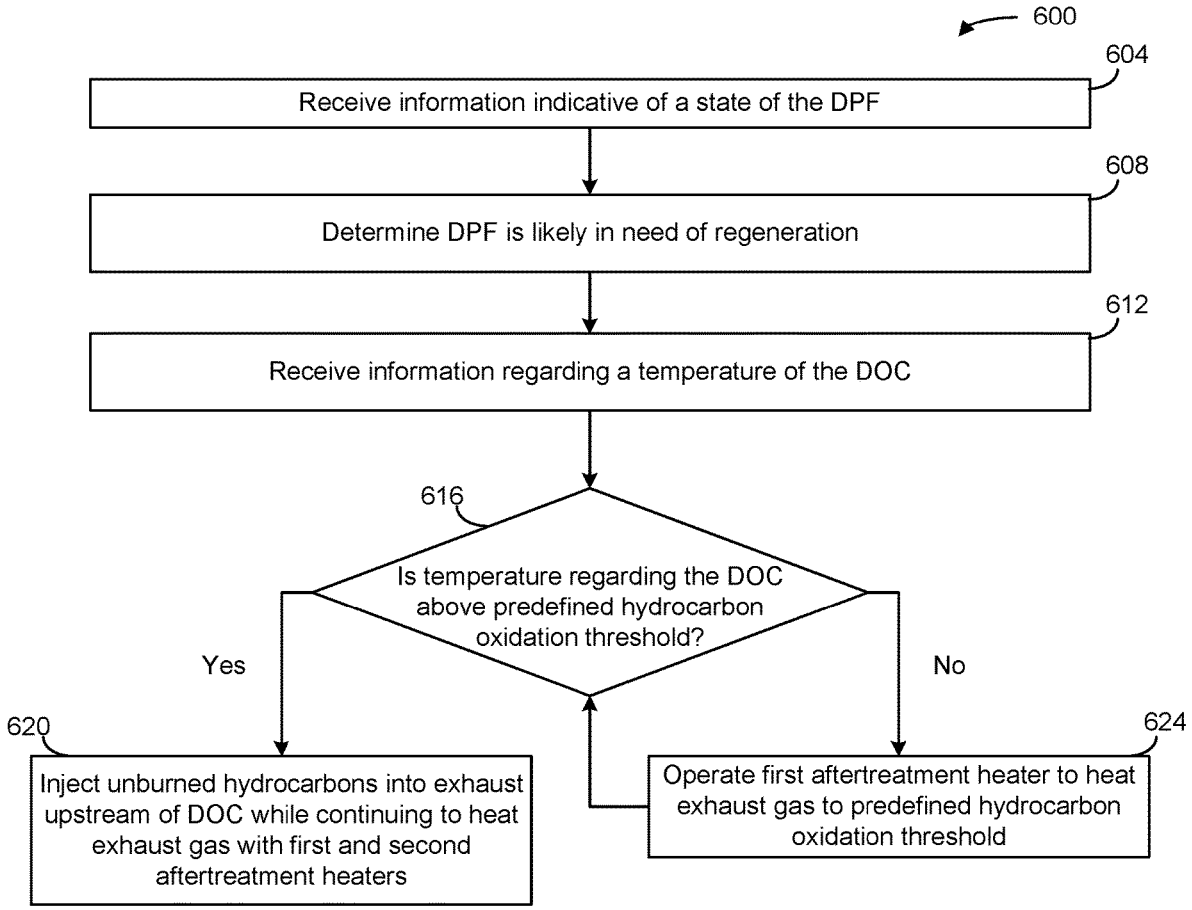
FIG. 6 is a flow diagram of a method for regenerating a diesel particulate filter of the exhaust aftertreatment system of FIG. 1 according to an example embodiment.

FIG. 6 illustrates an exemplary method 600 for heating an exhaust aftertreatment system 22 to regenerate the DPF 28 according to an exemplary embodiment. At process 604, the aftertreatment heating circuit 216 receives information indicative of a state of the DPF 28. Information indicative of the state of the DPF 28 may include a pressure drop across the DPF 28. At process 608, the aftertreatment heating circuit 216 determines a likelihood that the DPF 28 is in need of regeneration based on the information indicative of the state of the DPF 28. At process 612, in response to determining that the DPF 28 is likely in need of regeneration, the aftertreatment heating circuit 216 receives information regarding a temperature of the DOC 26. At process 616, the aftertreatment heating circuit 216 compares the information regarding the temperature of the DOC 26 to a predefined HC oxidation threshold. The predefined HC oxidation threshold is a temperature or a range of temperatures at or above which unburned HCs injected upstream of the DOC 26 react with the DOC 26 in an exothermic reaction. At process 620, in response to determining that the temperature regarding the DOC 26 is above the predefined HC oxidation threshold, the aftertreatment heating circuit 216 commands injection of unburned HC into the exhaust gas upstream of the DOC 26, creating an exothermic reaction across the DOC 26 and increasing a temperature of the exhaust gas to regenerate the DPF 28.

At process 624, in response to determining that the temperature regarding the DOC 26 is less than or equal to the predefined HC oxidation threshold, the aftertreatment heating circuit 216 operates the first aftertreatment heater 24 to heat the exhaust gas to the predefined HC threshold.

Under cool or cold ambient temperature conditions, the intake heater 19 heats the intake air that is used for combustion, which promote higher combustion temperatures, which, in turn heats the engine 16 and the exhaust aftertreatment system 22. In embodiments in which the vehicle 10 includes the intake heater 19, the intake heating circuit 220 is structured to control the intake heater 19 to modulate a temperature of air entering the air intake manifold 18 and/or to heat the exhaust aftertreatment system 22.

In some embodiments, the intake heating circuit 220 may operate the intake heater 19 under cold start engine operating conditions. The intake heating circuit 220 is structured to receive information indicative of a characteristic of the battery 17. The characteristic of the battery 17 may include one or more of the SOC of the battery 17, the SOH of the battery 17, and the voltage of the battery 17. The intake heating circuit 220 is structured to compare the characteristic of the battery 17 to a predefined battery characteristic threshold. The predefined battery characteristic threshold may be one or more of a SOC threshold, a SOH threshold, and a voltage threshold indicating that the battery 17 can power the second aftertreatment heater 30 for at least a predefined time period. In response to determining that the characteristic of the battery 17 is below the predefined battery threshold, the intake heating circuit 220 is structured to increase a temperature of the exhaust gas without using the intake heater 19. The intake heating circuit 220 may increase the temperature of the exhaust gas without using the intake heater 19 by one or more of changing engine operations, HC dosing, post-fuel injection, or manipulation of charge air to increase a temperature of the exhaust gas. The intake heating circuit 220 does not activate the intake heater 19.

In response to determining that the characteristic of the battery 17 is above the predefined battery characteristic threshold, the aftertreatment heating circuit 216 is structured to heat the air entering the air intake manifold 18 using the intake heater 19 for a predefined engine warm-up time period (this may be dependent on the ambient outside temperature such that colder ambient temperatures correspond with longer warm-up periods). The predefined engine warm-up time period may be an amount of time for the engine 16 to reach a predefined engine temperature threshold (or, another threshold such as an oil temperature or flow rate, etc.).

The intake heating circuit 220 is structured to receive information indicative of the temperature regarding the exhaust aftertreatment system 22. The intake heating circuit 220 is structured to determine the temperature regarding the exhaust aftertreatment system 22 as described above with respect to the aftertreatment heating circuit 216. The intake heating circuit 220 is structured to compare the temperature regarding the aftertreatment system 22 to a predefined aftertreatment temperature threshold. The predefined aftertreatment temperature threshold is substantially the same as the predefined aftertreatment temperature threshold described above with respect to the aftertreatment heating circuit 216. In response to determining that the temperature regarding the exhaust aftertreatment system 22 is at or below the predefined aftertreatment threshold, the intake heating circuit 220 is structured to increase the temperature regarding the exhaust aftertreatment system 22.

In embodiments that include the second aftertreatment heater 30, the intake heating circuit 220 may receive information indicating that the second aftertreatment heater 30 may be in an error state. Conditions that establish the error state may include one or more fault codes, determining that a temperature downstream of the second aftertreatment heater 30 is not increasing, and/or a voltage and/or a current going through the second aftertreatment heater 30. In response to determining that the second aftertreatment heater 30 is not likely in an error state, the intake heating circuit 220 is structured to disable the intake heater 19 after the predefined engine warm-up time period. The aftertreatment heating circuit 216 is structured to heat the exhaust gas in the exhaust aftertreatment system 22 using the second aftertreatment heater 30.

In response to determining that the second aftertreatment heater 30 is likely in an error state or that the exhaust aftertreatment system 22 does not include the second aftertreatment heater 30, the intake heating circuit 220 is structured to continue heating the air entering the air intake manifold 18 after the predefined engine warm-up time period. The intake heating circuit 220 is structured to stop heating the air entering the air intake manifold 18 in response to determining that the temperature regarding the exhaust aftertreatment system 22 is above the predefined aftertreatment temperature threshold.

In embodiments including both the first aftertreatment heater 24 and the second aftertreatment heater 30, the aftertreatment heating circuit 216 may operate the first aftertreatment heater 24 to heat the exhaust aftertreatment system 22 in response to determining that the second aftertreatment heater 30 is likely in an error state. In embodiments including both the first aftertreatment heater 24 and the second aftertreatment heater 30, the intake heating circuit 220 may operate the intake heater 19 to heat the exhaust aftertreatment system 22 in response to determining that both the first aftertreatment heater 24 and the second aftertreatment heater 30 are likely in an error state. In some embodiments, the intake heater 19, the first aftertreatment heater 24, and the second aftertreatment heater 30 may all be activated to provide heat to the exhaust aftertreatment system 22, based on the power available for the power source for the heaters (e.g., the battery 17 and/or the alternator 15).

Figure 7:
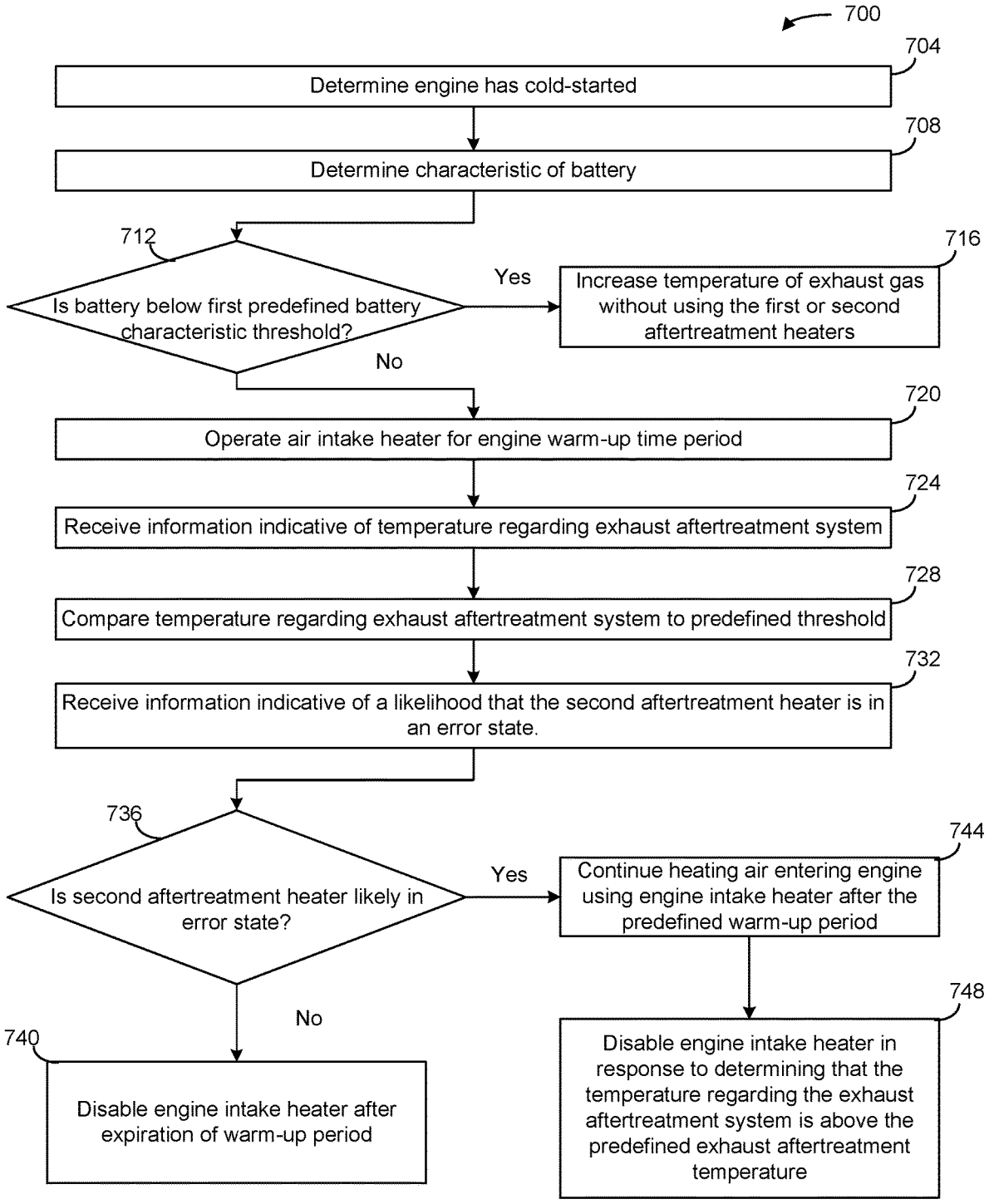
FIG. 7 is a flow diagram of a method for heating the exhaust aftertreatment system of FIG. 1 after a cold start according to another example embodiment.

FIG. 7 illustrates an exemplary method 700 for heating an exhaust aftertreatment system 22 using the intake heater 19 after a cold start according to an exemplary embodiment. The method 700 initiates in response to the aftertreatment heating circuit 216 determining that the engine 16 is undergoing a cold start, at process 704. At process 708, the intake heating circuit 220 receives information indicative of a characteristic of the battery 17 and determines the characteristic of the battery 17. The characteristic of the battery 17 may include one or more of the SOC of the battery 17, the SOH of the battery 17, and the voltage of the battery 17. At process 712, the intake heating circuit 220 compares the characteristic of the battery 17 to a predefined battery characteristic threshold. The predefined battery characteristic threshold may be one or more of a SOC threshold, a SOH threshold, and a voltage threshold indicating that the battery 17 can power the first aftertreatment heater 24 for at least a predefined time period. At process 716, in response to determining that the characteristic of the battery 17 is below the predefined battery threshold, the intake heating circuit 220 is structured to increase a temperature of the exhaust gas without using the intake heater 19. Increasing the temperature of the exhaust gas without using the intake heater 19 may include one or more of changing engine operations, HC dosing, post-fuel injection, or manipulation of charge air to increase a temperature of the exhaust gas. The intake heating circuit 220 does not activate the intake heater 19.

At process 720, in response to determining that the characteristic of the battery 17 is above the predefined battery characteristic threshold, the aftertreatment heating circuit 216 heats the air entering the air intake manifold 18 using the intake heater 19 for a predefined engine warm-up time period.

At process 724, the intake heating circuit 220 receives information indicative of the temperature regarding the exhaust aftertreatment system 22. At process 728, the intake heating circuit 220 compares the temperature regarding the aftertreatment system 22 to a predefined aftertreatment temperature threshold. At process 732, in response to determining that the temperature regarding the exhaust aftertreatment system 22 is at or below the predefined aftertreatment temperature threshold, the intake heating circuit 220 receives information indicating a likelihood that the second aftertreatment heater 30 may be in an error state.

At process 736, in embodiments that include the second aftertreatment heater 30, the intake heating circuit 220 may receive information indicating that the second aftertreatment heater 30 may be in an error state. At 740, in response to determining that the second aftertreatment heater 30 is not likely in an error state, the intake heating circuit 220 turns off the intake heater 19 after the predefined engine warm-up time period. The aftertreatment heating circuit 216 heats the exhaust gas in the exhaust aftertreatment system 22 using the second aftertreatment heater 30. At process 744, in response to determining that the second aftertreatment heater 30 is likely in an error state, the intake heating circuit 220 continues heating the air entering the intake heater 19 after the predefined engine warm-up time period. In embodiments that do not include the second aftertreatment heater 30, the intake heating circuit 220 skips processes 736 and 740. At process 748, the intake heating circuit 220 stops heating the air entering the air intake manifold 18 in response to determining that the temperature regarding the exhaust aftertreatment system 22 is above the predefined aftertreatment temperature threshold.

Figure 8:
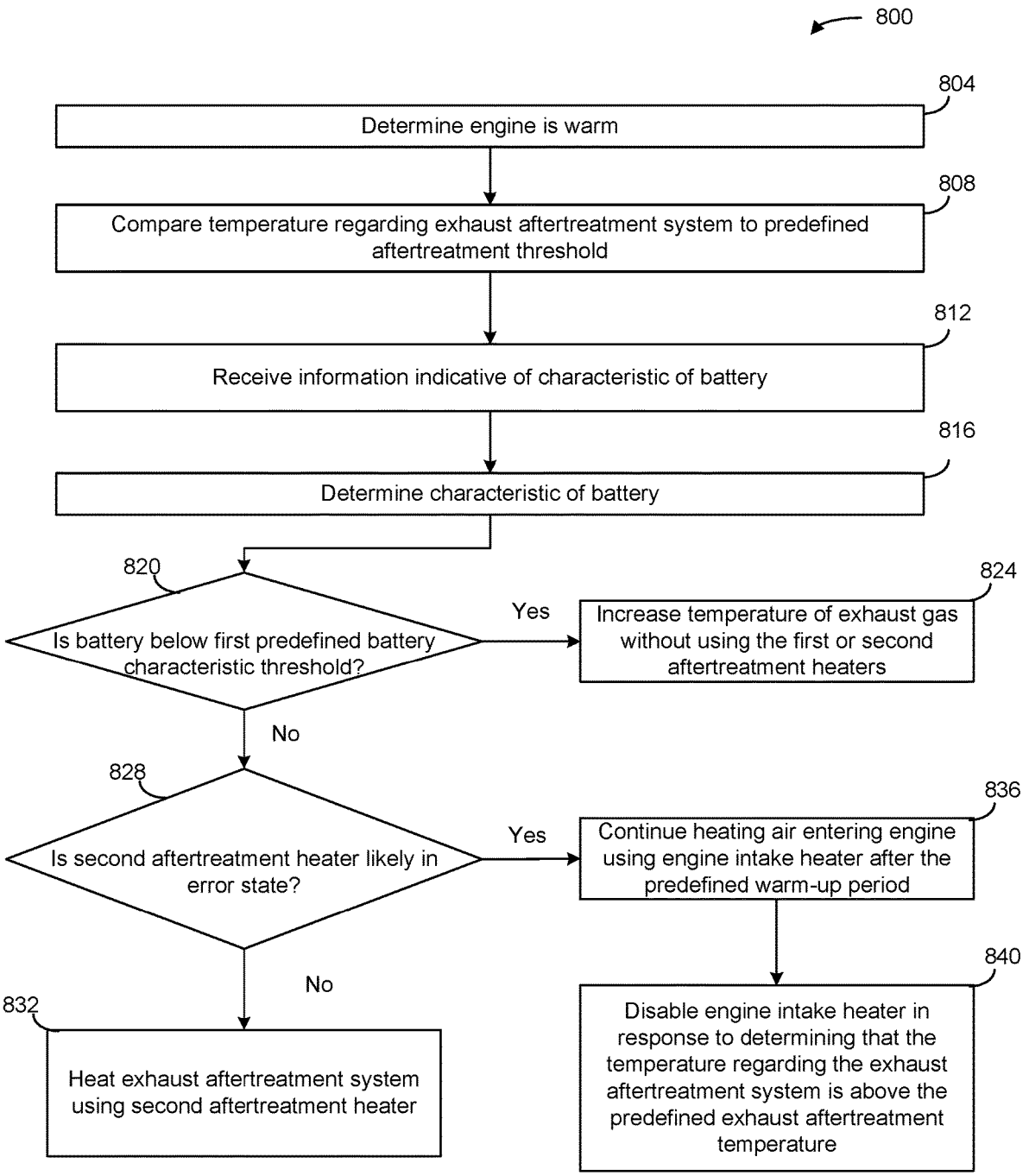
FIG. 8 is a flow diagram of a method for heating the exhaust aftertreatment system of FIG. 1 after the engine has warmed up according to an example embodiment.

FIG. 8 illustrates an exemplary method 800 for heating an exhaust aftertreatment system using the intake heater 19 after the engine 16 is warm according to an exemplary embodiment. The method 800 initiates in response to the aftertreatment heating circuit 216 determining that the engine 16 warm (e.g., that the engine 16 has not recently undergone a cold start). At process 804, the intake heating circuit 220 is structured to receive information indicative of the temperature regarding the exhaust aftertreatment system 22. At process 808, the intake heating circuit 220 is structured to compare the temperature regarding the aftertreatment system 22 to a predefined aftertreatment temperature threshold. At process 812, in response to determining that the temperature regarding the exhaust aftertreatment system 22 is at or below the predefined aftertreatment threshold, the intake heating circuit 220 requests information indicative of a characteristic of the battery 17.

At process 816, the intake heating circuit 220 receives information indicative of the characteristic of the battery 17. The characteristic of the battery 17 may include one or more of the SOC of the battery 17, the SOH of the battery 17, and a voltage of the battery 17. At process 820, the intake heating circuit 220 compares the characteristic of the battery 17 to a predefined battery characteristic threshold. The predefined battery characteristic threshold may be one or more of a SOC threshold, a SOH threshold, and a voltage threshold indicating that the battery 17 can power the intake heater 19 and/or the second aftertreatment heater 30 for at least a predefined time period. At process 824, in response to determining that the characteristic of the battery 17 is below the predefined battery threshold, the intake heating circuit 220 increases a temperature of the exhaust gas without using the intake heater 19. Increasing the temperature of the exhaust gas without using the intake heater 19 may include one or more of changing engine operations, HC dosing, post-fuel injection, or manipulation of charge air to increase a temperature of the exhaust gas. The intake heating circuit 220 does not activate the intake heater 19.

At process 828, in embodiments that include the second aftertreatment heater 30, the intake heating circuit 220 may receive information indicating that the second aftertreatment heater 30 may be in an error state. At 832, in response to determining that the second aftertreatment heater 30 is not likely in an error state, the aftertreatment heating circuit 216 heats the exhaust gas in the exhaust aftertreatment system 22 using the second aftertreatment heater 30. At 836, in response to determining that the second aftertreatment heater 30 is likely in an error state or in embodiments that do not include the second aftertreatment heater 30, the intake heating circuit 220 continues heating the air entering the air intake manifold 18 with the intake heater 19. At 840, the intake heating circuit 220 stops heating the air entering the air intake manifold 18 in response to determining that the temperature regarding the exhaust aftertreatment system 22 is above the predefined aftertreatment temperature threshold.

No claim element herein is to be construed under the provisions of 35 U.S.C. § 112(f), unless the element is expressly recited using the phrase "means for."

For the purpose of this disclosure, the term "coupled" means the joining or linking of two members directly or indirectly to one another. Such joining may be stationary or moveable in nature. For example, a propeller shaft of an engine "coupled" to a transmission represents a moveable coupling. Such joining may be achieved with the two members or the two members and any additional intermediate members. For example, circuit A communicably "coupled" to circuit B may signify that circuit A communicates directly with circuit B (i.e., no intermediary) or communicates indirectly with circuit B (e.g., through one or more intermediaries).

While various circuits with particular functionality are shown in FIG. 2 it should be understood that the controller 14 may include any number of circuits for completing the functions described herein. For example, the activities and functionalities of the circuits 220-222 may be combined in multiple circuits or as a single circuit. Additional circuits with additional functionality may also be included. Further, the controller 14 may further control other activity beyond the scope of the present disclosure.

As mentioned above and in one configuration, the "circuits" may be implemented in machine-readable medium for execution by various types of processors, such as the processor 208 of FIG. 2. An identified circuit of executable code may, for instance, comprise one or more physical or logical blocks of computer instructions, which may, for instance, be organized as an object, procedure, or function. Nevertheless, the executables of an identified circuit need not be physically located together, but may comprise disparate instructions stored in different locations which, when joined logically together, comprise the circuit and achieve the stated purpose for the circuit. Indeed, a circuit of computer readable program code may be a single instruction, or many instructions, and may even be distributed over several different code segments, among different programs, and across several memory devices. Similarly, operational data may be identified and illustrated herein within circuits, and may be embodied in any suitable form and organized within any suitable type of data structure. The operational data may be collected as a single data set, or may be distributed over different locations including over different storage devices, and may exist, at least partially, merely as electronic signals on a system or network.

While the term "processor" is briefly defined above, the term "processor" and "processing circuit" are meant to be broadly interpreted. In this regard and as mentioned above, the "processor" may be implemented as one or more general-purpose processors, application specific integrated circuits (ASICs), field programmable gate arrays (FPGAs), digital signal processors (DSPs), or other suitable electronic data processing components structured to execute instructions provided by memory. The one or more processors may take the form of a single core processor, multi-core processor (e.g., a dual core processor, triple core processor, quad core processor), microprocessor, etc. In some embodiments, the one or more processors may be external to the apparatus, for example the one or more processors may be a remote processor (e.g., a cloud based processor). Alternatively or additionally, the one or more processors may be internal and/or local to the apparatus. In this regard, a given circuit or components thereof may be disposed locally (e.g., as part of a local server, a local computing system) or remotely (e.g., as part of a remote server such as a cloud based server). To that end, a "circuit" as described herein may include components that are distributed across one or more locations.

Although the diagrams herein may show a specific order and composition of method steps, the order of these steps may differ from what is depicted. For example, two or more steps may be performed concurrently or with partial concurrence. Also, some method steps that are performed as discrete steps may be combined, steps being performed as a combined step may be separated into discrete steps, the sequence of certain processes may be reversed or otherwise varied, and the nature or number of discrete processes may be altered or varied. The order or sequence of any element or apparatus may be varied or substituted according to alternative embodiments. All such modifications are intended to be included within the scope of the present disclosure as defined in the appended claims. Such variations will depend on the machine-readable media and hardware systems chosen and on designer choice. All such variations are within the scope of the disclosure.

The foregoing description of embodiments has been presented for purposes of illustration and description. It is not intended to be exhaustive or to limit the disclosure to the precise form disclosed, and modifications and variations are possible in light of the above teachings or may be acquired from this disclosure. The embodiments were chosen and described in order to explain the principles of the disclosure and its practical application to enable one skilled in the art to utilize the various embodiments and with various modifications as are suited to the particular use contemplated. Other substitutions, modifications, changes and omissions may be made in the design, operating conditions and arrangement of the embodiments without departing from the scope of the present disclosure as expressed in the appended claims.

Accordingly, the present disclosure may be embodied in other specific forms without departing from its spirit or essential characteristics. The described embodiments are to be considered in all respects only as illustrative and not restrictive. The scope of the disclosure is, therefore, indicated by the appended claims rather than by the foregoing description. All changes which come within the meaning and range of equivalency of the claims are to be embraced within their scope.

What is claimed is:

1. A system comprising:

a first heater positioned in an exhaust aftertreatment system in exhaust gas-receiving communication with an engine;

a second heater positioned downstream of the first heater; and a controller coupled to the first and second heaters, the controller configured to:

determine, based on information indicative of a temperature regarding the exhaust aftertreatment system, that the temperature regarding the exhaust aftertreatment system is below a predefined temperature threshold;

receive information regarding a characteristic of a battery coupled to the first heater and the second heater;

determine one of that the characteristic of the battery is above the first predefined threshold but below a second predefined threshold, or that the characteristic of the battery is above the second predefined threshold;

based on the determination that the characteristic of the battery is above the first predefined threshold but below the second predefined threshold, control the temperature regarding the exhaust aftertreatment system using the first heater; and based on the determination that the characteristic of the battery is above the second predefined threshold, control the temperature regarding the exhaust aftertreatment system using the first heater and the second heater simultaneously.

2. The system of claim 1, wherein the controller is configured to modulate an amount of heat provided by the first heater based on the characteristic of the battery, wherein the characteristic of battery is at least one of a state of charge (SOC), a state of health (SOH), or a voltage.

3. The system of claim 1, wherein the controller is configured to control the temperature regarding the exhaust aftertreatment system using the second heater in response to determining that the first heater is in or likely in an error state.

4. The system of claim 1, wherein the controller is configured to control the temperature regarding the exhaust aftertreatment system using the first heater and the second heater in response to determining that the temperature regarding the exhaust aftertreatment system is below a second predefined temperature threshold after a predefined time period.

5. The system of claim 1, wherein the exhaust aftertreatment system comprises a diesel oxidation catalyst (DOC) and a diesel particulate filter; and wherein the controller is configured to:

compare information regarding the DOC temperature to a predefined hydrocarbon (HC) oxidation threshold; and responsive to determining that the temperature regarding the DOC is below the predefined HC oxidation threshold, control the temperature regarding the DOC using the first heater; or responsive to determining that the temperature regarding the DOC is at or above the predefined HC oxidation threshold, command unburnt HC to be injected into the exhaust gas upstream of the DOC to increase a temperature of the diesel particulate filter.

6. The system of claim 1, wherein the exhaust aftertreatment system comprises a SCR catalyst, and wherein the information indicative of the temperature regarding the exhaust aftertreatment system is one or more of an engine out exhaust gas temperature, an engine coolant temperature, a temperature regarding the SCR catalyst, and a difference between an exhaust aftertreatment system inlet nitrous oxides (NOx) concentration and an exhaust aftertreatment system outlet NOx concentration.

7. The system of claim 1, wherein the controller is configured to:

determine a heating time based on the information indicative of the temperature regarding the exhaust aftertreatment system; and control the temperature regarding the exhaust aftertreatment system for the heating time.

* * * * *